US005794811A

United States Patent [19]

Walsh

[11] Patent Number: 5,794,811

[45] Date of Patent: Aug. 18, 1998

[54] CARTON, CARTON BLANK AND METHOD FOR FORMING THE CARTON

[75] Inventor: Joseph C. Walsh, Longmont, Colo.

[73] Assignee: Graphic Packaging Corporation, Boulder, Colo.

[21] Appl. No.: 741,342

[22] Filed: Oct. 29, 1996

Related U.S. Application Data

[63] Continuation-in-part of Ser. No. 587,467, Jan. 17, 1996, Pat. No. 5,632,404, and Ser. No. 587,495, Jan. 17, 1996, each is a continuation-in-part of Ser. No.352,526, Dec. 9, 1994, abandoned, and Ser. No. 336,982, Nov. 14, 1994, abandoned, each is a continuation-in-part of Ser. No.51,628, Apr. 22, 1993, abandoned, which is a continuation-in-part of Ser. No. 994,132, Dec. 21, 1992, abandoned.

[51] Int. Cl.[6] ..... B65D 5/56

[52] U.S. Cl. ..... 220/462; 53/491; 220/418; 229/198.2; 493/183

[58] Field of Search ..... 220/416, 418, 220/460–463; 229/3.1, 198.2; 493/96, 97, 162, 183; 53/485, 491

[56] References Cited

U.S. PATENT DOCUMENTS

| | | | |
|---|---|---|---|
| 1,845,891 | 2/1932 | Schroeder | 229/198.2 |
| 2,196,243 | 3/1940 | Bensel | 220/418 |
| 2,305,371 | 12/1942 | Yates | 220/418 |
| 2,416,332 | 2/1947 | Lehman | 229/125.32 |
| 2,550,520 | 4/1951 | Bennett | 229/198.2 |
| 2,996,235 | 8/1961 | Turpin | 220/418 |
| 3,194,471 | 7/1965 | Murphy | 220/416 |
| 3,198,416 | 8/1965 | Hickin et al. | 220/418 |
| 3,288,345 | 11/1966 | Dilot | 220/461 |
| 3,640,447 | 2/1972 | Forbes, Jr. et al. | 220/418 |
| 3,910,482 | 10/1975 | Bamburg et al. | 220/418 |
| 3,951,333 | 4/1976 | Forbes, Jr et al. | 220/418 |
| 4,053,102 | 10/1977 | Stark | 220/418 |
| 4,077,309 | 3/1978 | Marbot | 493/183 |
| 4,139,119 | 2/1979 | McLaren | 220/461 |
| 4,171,064 | 10/1979 | Friess et al. | 220/418 |
| 4,189,986 | 2/1980 | Silver | 493/183 |
| 4,254,173 | 3/1981 | Peer, Jr. | 220/462 |
| 4,471,884 | 9/1984 | Kuchenbecker | 220/462 |
| 4,526,314 | 7/1985 | Reil | 220/462 |
| 4,720,015 | 1/1988 | Brauner | 220/461 |
| 4,768,703 | 9/1988 | Sosler et al. | 220/461 |
| 4,771,938 | 9/1988 | Hambleton | 220/418 |
| 4,927,075 | 5/1990 | Lisiecki | 493/183 |

FOREIGN PATENT DOCUMENTS

| | | | |
|---|---|---|---|
| 239316 | 9/1987 | European Pat. Off. | 229/3.1 |
| 71594 | 5/1957 | France | 53/491 |
| 1516536 | 1/1968 | France | 229/3.1 |
| 208467 | 3/1909 | Germany | 220/460 |
| 451579 | 3/1975 | U.S.S.R. | 53/491 |
| 176994 | 3/1922 | United Kingdom | 220/418 |

*Primary Examiner*—Gary E. Elkins

*Attorney, Agent, or Firm*—Klaas, Law, O'Meara & Malkin, P.C.; Joseph J. Kelly

[57] ABSTRACT

A carton blank for forming a leakproof carton comprising an outer enclosure formed from a relatively rigid material an openable top a closed bottom and a central body and a leakproof inner liner having a central body portion secured to the central body of the outer enclosure, a closed bottom and an openable closed top so that after portions of the material in the carton have been removed the top portion and adjacent portions of the inner liner's central body may be separated from the central body of the outer enclosure and folded downwardly to protect the remaining material in the carton. In one embodiment, after all the material has been removed from the carton, the leakproof inner liner may be completely removed from the outer enclosure.

17 Claims, 10 Drawing Sheets

CARTON, CARTON BLANK AND METHOD FOR FORMING THE CARTON

This application is a continuation-in-part of U.S. patent applications Ser. No. 08/587,467 filed Jan. 17, 1996, now U.S. Pat. No. 5,632,404 and No. 08/587,495 filed Jan. 17, 1996, both of which are continuation-in-part applications of U.S. patent application Ser. No. 08/352,526 filed Dec. 9, 1994 (now abandoned) and U.S. patent application Ser. No. 08/336,982 filed Nov. 14, 1994 now abandoned both applications being continuations-in-part of U.S. patent application Ser. No. 08/051,628 (now abandoned) filed Apr. 22, 1993 which application was a continuation-in-part of U.S. patent application Ser. No. 07/994,132 filed Dec. 21, 1992 (now abandoned).

FIELD OF THE INVENTION

This invention is directed generally to carton blanks and apparatus and method for forming the carton blanks and more particularly to apparatus and method for forming carton blanks that can be used to form leakproof cartons having reclosable inner portions to form an effective seal after the leakproof carton has been opened.

BACKGROUND OF THE INVENTION

There are many supposedly leakproof cartons on the market today. These are formed using a variety of methods. Some of the cartons are designed to hold granular materials while others are designed to hold liquid materials. While some of these leakproof cartons have been successful, there is always a need for improvement including the formation of the top inner portion.

BRIEF DESCRIPTION OF THE INVENTION

This invention provides a carton blank and a leakproof carton formed therefrom wherein, after the leakproof carton has been opened, a top body portion and successive incremental portions of a central body portion of a relatively flexible fluid impervious material may be folded downwardly into the leakproof carton as portion of the material are removed from the leakproof carton to protect the remaining portions of the material in the carton and wherein, after all the material has been removed, the relatively flexible fluid impervious material may be removed.

In a preferred embodiment of the invention, the carton blank comprises a unitary sheet of a relatively rigid material having an inner surface and an outer surface, a left side edge, a right side edge, a top edge and a bottom edge. The unitary sheet of a relatively rigid material has a length extending from the top edge to the bottom edge and width extending from the left side edge of the right side edge. The unitary sheet of a relatively rigid material has a plurality of cut and fold lines for dividing the unitary sheet of a relatively rigid material into a back panel, a front panel, opposite sidewall panels, a glue tab panel and top and bottom panels extending outwardly in opposite directions from the front, back and opposite sidewall panels. The glue tab panel has a top edge and a bottom edge and a perforated line extending from the top edge toward the bottom edge and in some instances completely to the bottom edge. The inner surface defined by the front panel, the back panel, the opposite sidewall panels and the glue tab panel has a central body portion, a top body portion and a bottom body portion with the central body portion located between and spaced from the fold lines between the front panel, the back panel and the opposite sidewall panels and the top and bottom panels and extending into the glue tab panel. A generally rectangular sheet of a relatively flexible fluid impervious material is provided and has an inner surface and an outer surface, a central body portion, a top body portion, a bottom body portion, a left side edge, a right side edge and top and bottom edges. The generally rectangular sheet of a relatively flexible fluid impervious material has a length and a width which corresponds to the length and the width of the unitary sheet of a relatively rigid material. The central body portion of the rectangular sheet of a relatively flexible fluid sheet of a relatively flexible fluid impervious material is secured to the central body portion of the front panel, the back panel, the opposite sidewall panels and the glue tab panel. At least portions of the central body portion of the generally rectangular sheet of a relatively flexible fluid impervious material are secured by an adhesive permitting separation thereof from adjacent portions of the central body portion of the front panel, the back panel, the opposite sidewall panels and the glue tab panel without damage thereto by the application of sufficient force which portions extend downwardly from the top of the central body portion toward the bottom body portion thereof and, in some instances, to the bottom body portion. At least portions of the top and bottom body portions of the generally rectangular sheet of a relatively flexible fluid impervious material overlie but are not secured to the top and bottom body portions of the front panel, the back panel, the opposite sidewall panels and the top and bottom panels. Preferably, a sheet of a relatively flexible material is secured to the top and bottom body portions of the generally rectangular sheet of a relatively flexible fluid impervious material.

The portion of the glue tab panel between the perforated line and one of the left or right side edges is secured to the central body portion of the generally rectangular sheet of a relatively flexible fluid impervious material with an adhesive so that the portion moves with the at least portions of the central body portion of the rectangular sheet of a relatively flexible fluid impervious material as the at least portions are being separated from the central body portion of the front panel, the back panel, the opposite sidewall panels and the adjacent portion of the glue tab panel.

During the formation of the above-described carton blank into an open ended enclosure, a portion of the outer surface of the glue tab panel is skived away and a fold line extending form the top edge to the bottom edge of the glue tab panel is formed therein. The remaining portion has a thickness equal to about one-half of its original thickness.

A portion of the central body portion of the generally rectangular sheet of a relatively flexible fluid impervious material adjacent to one of the left or right side edge thereof is removed leaving a portion of the inner surface of the central body portion of the unitary sheet of a relatively rigid material exposed.

The open ended enclosure is formed by first folding on of the opposite sidewall panels and the glue tab panel around the foldline between the one of the opposite sidewall panels and the front or back panel. During this folding operation, the skived away portion around the fold line therein is form a continuous exposed strip of the relatively flexible fluid impervious material extending from the top edge to the bottom edge of the generally rectangular sheet. During the folding operations, a suitable adhesive is applied to the appropriate portions of the carton blank so that in the formed open ended enclosure the exposed portion of the inner surface of the central body portion of the unitary sheet of a relatively rigid material is secured to the non-skived portion of the glue tab panel, including the perforated line and the continuous strip of the relatively flexible fluid impervious material is secured to a superposed portion of the relatively flexible fluid impervious material that the open ended enclosure has a continuous inner surface.

In forming and filling a carton from the open ended enclosure, the bottom body portion of the generally rectangular sheet of a relatively flexible fluid impervious material is folded and secured together and the bottom panel portions are folded and secured together to form a bottom closed end so that the carton can be filled with a desired material. After being filled, the top body portion of the generally rectangular sheet of a relatively flexible fluid impervious material is folded and secured together and the top panel portions are folded and secured together to form a closed top end.

A method of forming an opened ended enclosure from the carton blank described above comprising folding the glue tab panel and one of the opposite sidewall panels and the portion of the generally rectangular sheet of a relatively flexible fluid impervious material secured thereto around a fold line between the one of the opposite sidewall panels and one of the front or back wall panels and forming extended fold lines in the top and bottom body portion of the generally rectangular sheet of a relatively flexible fluid impervious material; folding the at least portions of the glue tab panel located between the perforated line and the one of the left or right side edges and the other portions of the generally rectangular sheet of a relatively flexible fluid impervious secured thereto around the fold line in the glue tab panel and extending the fold line to include portions of the top and bottom body portions of the generally rectangular sheet of a relatively flexible fluid impervious material to form a continuous strip of the generally rectangular sheet of a relatively flexible fluid impervious material facing in the same direction as the outer surface of the remaining portion of the outer surface of the glue tab panel; folding the other of the front or back wall panels and the portion of the generally rectangular sheet of a relatively flexible fluid impervious material secured thereto around a fold line between the other of the front or back panels and the other of the opposite sidewall panels and forming extended fold lines in the top and bottom body portions of the generally rectangular sheet of a relatively flexible fluid impervious material and sealing together facing portions of the outer surface of the glue tab panel and the exposed inner surface of the other of the front or back panels and facing the continuous strip of a relatively flexible fluid impervious material and portions of the generally rectangular sheet of a relatively flexible fluid impervious material secured to the other of the front or back panels and the extensions thereof into the top and bottom body portions of the generally rectangular sheet of a relatively flexible fluid impervious material to form an open ended enclosure having a continuous inner surface formed from the generally rectangular sheet of a relatively flexible fluid impervious material.

The method further comprises forming a carton from the open ended enclosure comprising sealing together portions of the bottom body portion of the generally rectangular sheet of a relatively flexible material and the bottom panels to formed a carton having an open top and closed bottom filling the enclosure with a desired material and sealing together portions of the top body portion of the generally rectangular sheet of a relatively flexible fluid impervious material and the top panels to form a closed top.

The method further comprising opening the top panel portion and the portions of the top body portion of the generally rectangular sheet of a relatively flexible fluid impervious material removing some of the material form the carton; folding the top body portion and portions the central body portion of the generally rectangular sheet of a relatively flexible fluid impervious material to reclose the opening and severing the at least portions of the glue tab panel along the perforated line so that the portion of the glue tab panel may be folded with the central body portion of the generally rectangular sheet of a relatively flexible fluid impervious material. When all the material has been removed form the carton, the method further comprise separating the generally rectangular sheet of a relatively flexible material completely from the unitary sheet of a relatively rigid material.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
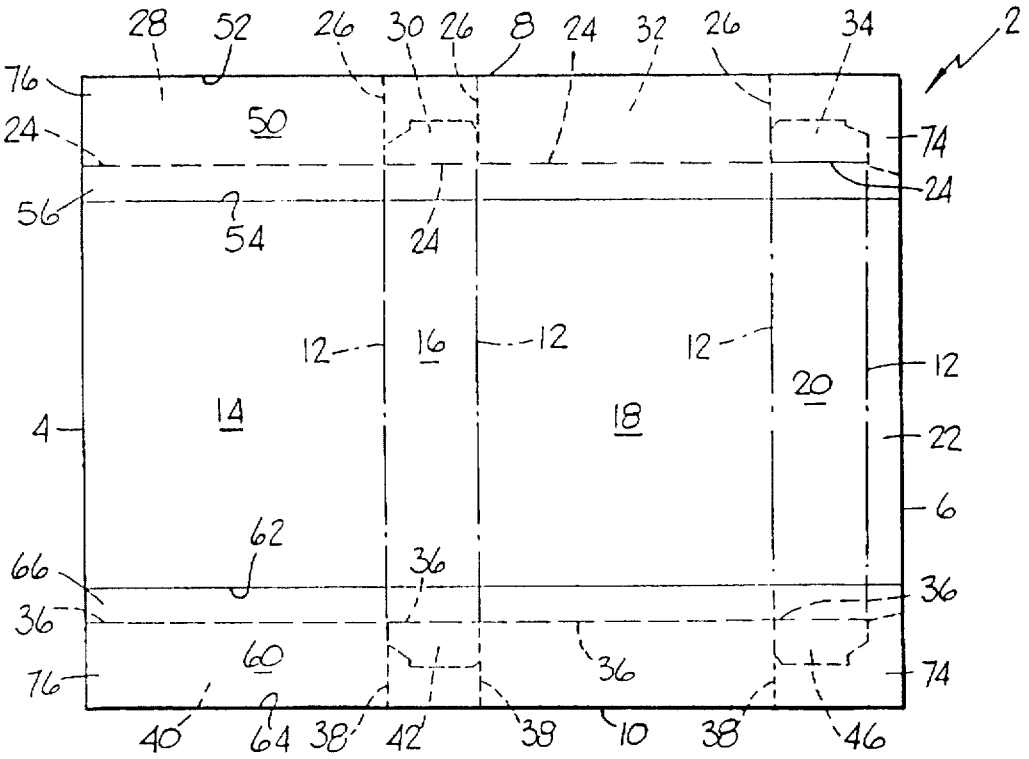
FIG. 1 is a top plan view of the inside portion of a carton blank of a preferred embodiment of the invention.
Figure 5:
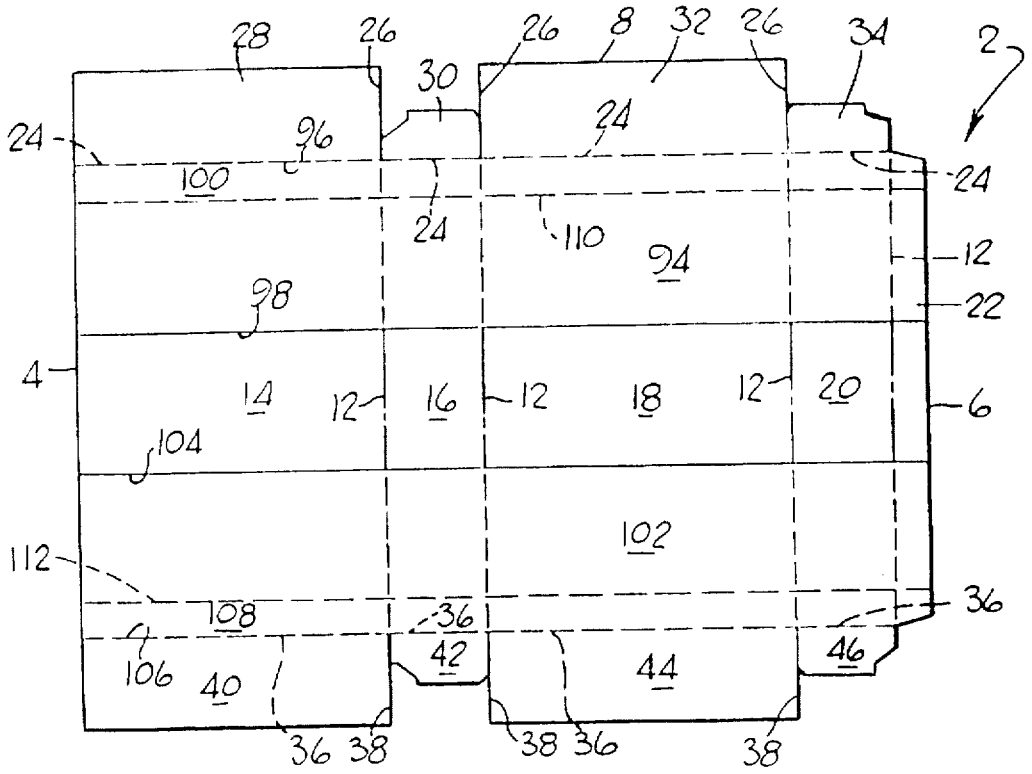
FIG. 5 is a top plan view of a carton blank of another preferred embodiment of the invention.
Figure 6:
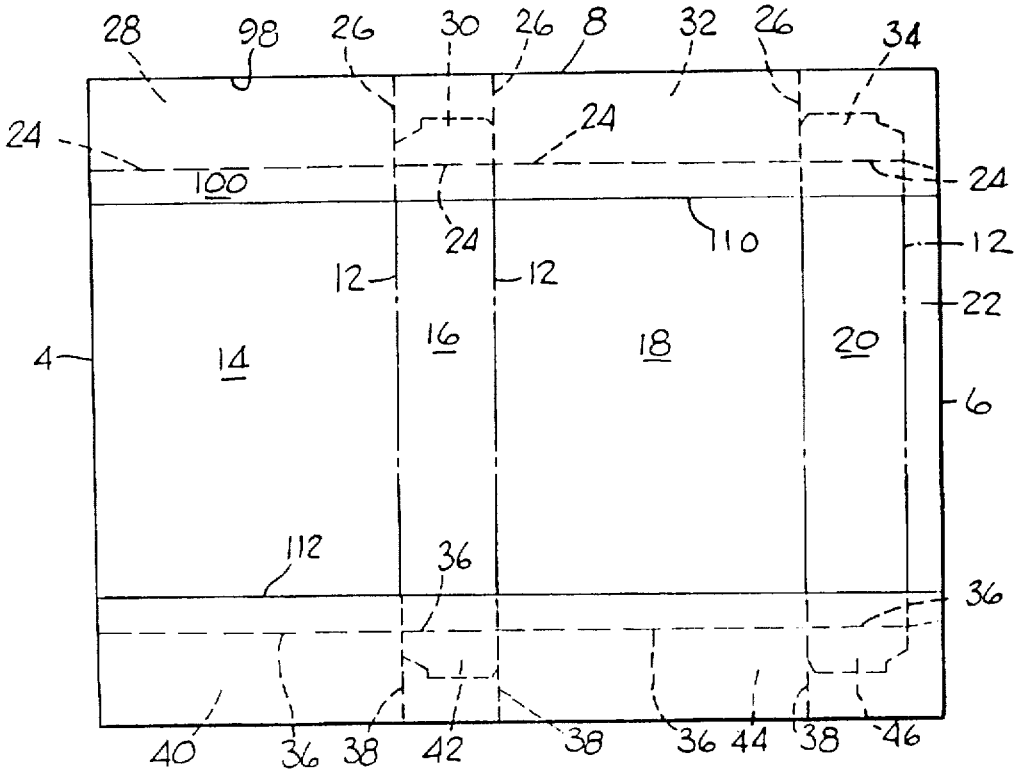
FIG. 6 is a top plan view of the carton blank of FIG. 5 after initial operations have been performed thereon.

In FIG. 1, there is illustrated the inner surface of a carton blank 2 of one preferred embodiment of the invention. The carton blank 2 has a left side edge 4, a right side edge 6, a top edge 8 and a bottom edge 10 with the left side and right side edges 4 and 6 being perpendicular to the top and bottom edges 8 and 10. A plurality of fold lines 12 divide the carton blank 2 into a back panel portion 14, a right side panel portion 16, a front panel portion 18, a left side panel portion 20 and a glue tab panel portion 22. A plurality of fold lines 24 and a plurality of cut lines 26 divide carton blank 2 into a top back panel portion 28, top right side panel portion 30, top front panel portion 32, and top left side panel portion 34. A plurality of fold lines 36 and cut lines 38 divide the carton blank 2 into bottom back panel portion 40, bottom right side panel portion 42, bottom front panel portion 44 and bottom left side panel portion 46. It is understood that the carton blank illustrated in FIGS. 1, 5 and 6 is for illustration purposes only and that this invention can be used with carton blanks of a variety of configurations.

A first sheet 50 of a relatively flexible fluid impervious material having an upper edge 52 and a lower edge 54 overlies the top back 28, top right side 30, top front 32 and top left side 34 panels portions and portions of the back 14, right side 16, front 18, left side 20 and glue tab 22 panels portions. A portion 56 of the first sheet 50 of a relatively flexible material between the fold lines 24 and the lower edge 54 and spaced a slight distance from the fold lines 24 is secured to the underlying portions of the back 14, right side 16, front 18, left side 20 and glue tab 22 panels portions so as to form a continuous seal extending from the left side edge 4 to the right side edge 6.

A second sheet 60 of a relatively flexible fluid impervious material having an upper edge 62 and a lower edge 64 overlies the bottom back 40, bottom right side 42, bottom front 44 and bottom left side 46 panels portions and portions of the back 14, right side 16, front 18, left side 20 and glue tab 22 panels portions. A portion 66 of the second sheet of a relatively flexible material between the fold lines 36 and the upper edge 62 and spaced a slight distance from the fold lines 36 is secured to the underlying portions of the back 14, right side 16, front 18, left side 20 and glue tab 22 panels portions so as to form a continuous seal extending from the left side edge 4 to the right side edge 6.

The first 50 and second 60 sheets of a relatively flexible material are preferably formed from a fluid impervious material, such as a paper material coated with a plastic material such as polyethylene such as that marketed by Eastman Kodak under the trade designation 808 P having a thickness between about 0.75 and 1.0 mils or other types of material having similar characteristics. The first 50 and second 60 sheets can be formed from a plastic material, such as polypropylene, or other materials having similar characteristics. The portions 56 and 66 are secured using adhesive or welding or other conventional sealing practices. The carton blank preferably comprises a unitary sheet of a composite laminate of layers of materials. The inside layer preferably comprises a paperboard material such as 0.021 inch DKL (recycled) or other similar materials such as natural Kraft board. The outside layer preferably comprises 0.75 mil polypropylene or other similar materials such as low density polyethylene which may be back printed to provide a desired appearance. Other thicknesses of the paperboard and plastic materials may be used. The method of forming the unitary sheet for forming the carton blank 2 is described in U.S. Pat. No. 4,254,173 to Peer, Jr., which is hereby incorporated herein by reference thereto. If the carton is to be used for holding liquids the inside surface is coated with a suitable material such a polyethylene or other materials having similar characteristics. Also, a portion or the glue tab panel portion 22 is skived and hemmed in a conventional manner with the polyethylene layer being folded over the exposed edge of the paperboard material.

Figure 2:
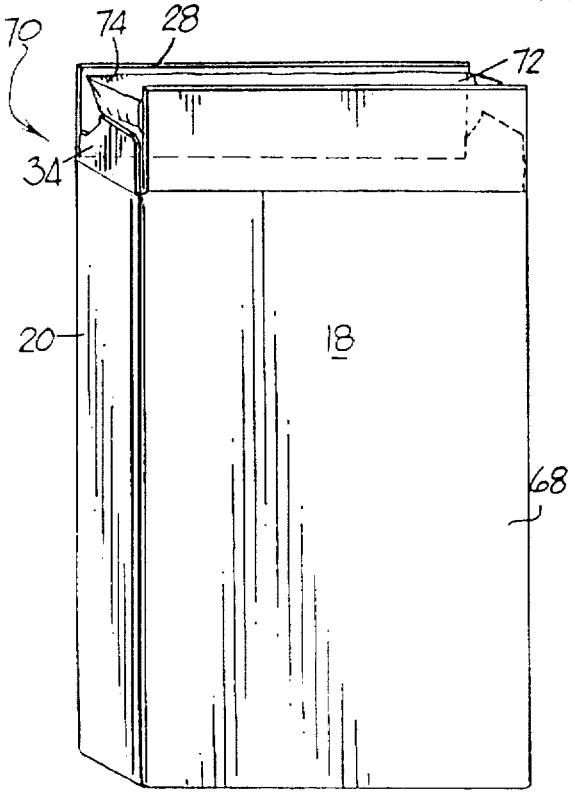
FIG. 2 is a perspective view of the carton blank of FIG. 1 slightly enlarged and folded so that desired materials may be placed therein.

In FIG. 2, there is illustrated the outer surface 68 of a partially formed carton 70 from the carton blank 2 and has an open top end 72 so that it is ready for filling. The carton 70 is formed by folding the glue tab panel portion 22 around a fold line 12, then the left side panel portion 20 is folded around a fold line 12, the front panel portion is folded around a fold line 12, and then the right side panel portion 16 is folded around a fold line 12 until the glue tab panel portion 22 overlies a portion of the back panel portion 14. The glue tab panel portion 22 is then secured to the portion of the back panel portion 14 using any conventional sealing practice. At the same time, the portions 74 of the first 50 and second 60 sheets of relatively flexible material are secured to the portions 76 thereof. The second sheet 60 of relatively flexible material is then secured together in a conventional manner as described below. The bottom back panel portion 40 is folded around a fold line 36, the bottom left side 46 and bottom right side 42 panels portions are folded around fold lines 36 so that they are in superposed relationship to portions of the bottom panel portion 40 and the bottom front panel portion 44 is folded around a fold line 36 to a superposed relationship. The bottom panels portions 40, 42, 46 and 44 are then secured together using any conventional sealing practice.

Figure 3:
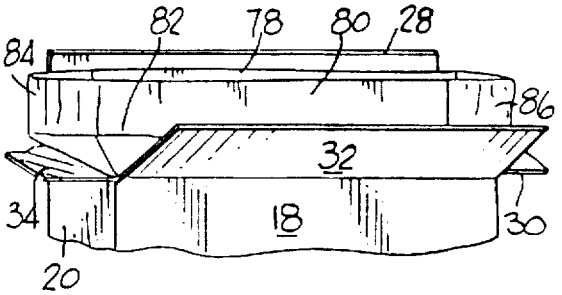
FIG. 3 is a perspective view of one closure for a sheet of relatively flexible material.
Figure 4:
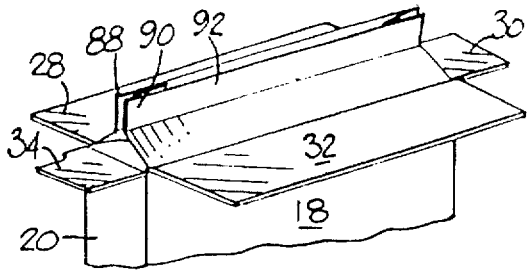
FIG. 4 is a perspective view of another closure for the sheet of relatively flexible material.

After the carton 70 has been filled, the carton is closed and sealed using conventional practices such as those illustrated in FIGS. 3 and 4. In FIG. 3, the portions 78 and 80 are secured together, then folded over the line 82. The end flaps 84 and 86 are then folded over to form a leakproof carton. The top panel portions 28, 30 and 32 and 34 are then folded and secured together in the same manner as that described above in relation to the bottom panels portions 40, 42 44 and 46.

In FIG. 4, a gable joint is used to seal the exposed portions of the first sheet 50 of the relatively flexible material. The portion of the first sheet 50 of a relatively flexible material above the left side panel portion is folded inwardly and secured together to form two end portions 88 and 90. The other end is formed in the same manner. The central portions 92 are secured together and they included the innermost portions of the end portions 88 and 90 to form a leakproof carton.

In FIGS. 5 and 6, there is illustrated another preferred embodiment of the invention. Since the carton 2 remains the same, it will be identified with the same reference numerals and the description remains the same.

A first sheet 94 of a relatively flexible fluid impervious material having an upper edge 96 and a lower edge 98 overlies portions of the back panel portion 14, right sidepanel portion 16, front panel portion 18, left side panel portion 20 and glue tab panel portion 22. A section 100 of the first sheet 94 of a relatively flexible material is secure to these panels portions at locations spaced a slight distance from the fold lines 24 by any conventional practice to form a continuous seal extending between the right side edge 4 to the left side edge 6.

A second sheet 102 of a relatively flexible fluid impervious material having an upper edge 104 and a lower edge 106 overlies other portions of the back panel portion 14, right side panel portion 16, front panel portion 18, left side panel portion 20 and glue tab panel portion 22. A section 108 of the first sheet 94 of a relatively flexible material is secured to these panels portions at locations spaced a slight distance from the fold lines 36 by any conventional practice to form a continuous seal extending between the right side edge 4 to the left side edge 6.

The first step in forming a carton from the carton blank 2 of FIG. 5 is illustrated in FIG. 6. The lower edge 98 of the first sheet 94 of a relatively flexible material is moved toward the top edge 8 until it is contiguous to the top edge 8 and portions of the first sheet 94 of a relatively flexible material overlie the section 100 and the top back panel portion 28, the top right side panel portion 30, the top front panel portion 32 and the top left side panel portion 34 and is creased along the line 110 to hold it in place. The upper edge 104 of the second sheet 102 of a relatively flexible material is moved toward the bottom edge 10 until it is contiguous to the bottom edge 10 and portions of the second sheet 102 of a relatively flexible material overlie the section 108 and the bottom back panel portion 40, the bottom right side panel portion 42, the bottom front panel portion 44 and the bottom left side panel portion 46 and is creased along the line 112 to hold it in place. A carton 70 is formed, filled and sealed as described above in relation to FIGS. 1–4.

Figure 7:
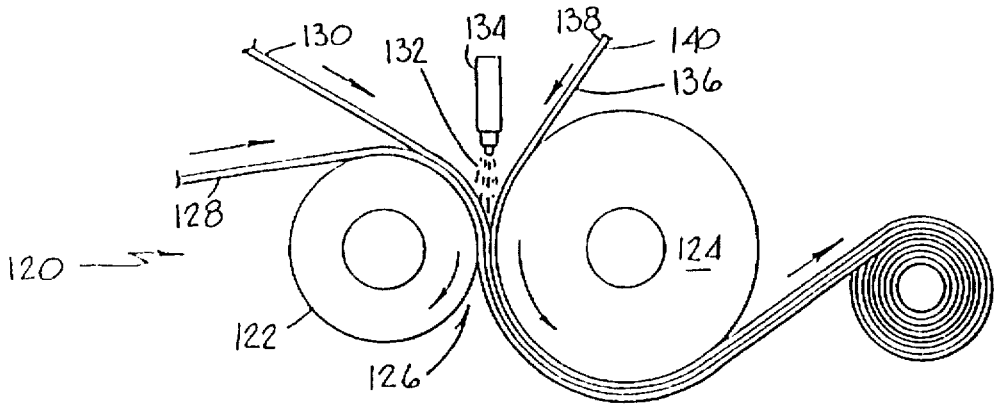
FIG. 7 is a schematic illustration of a laminating process.
Figure 10:
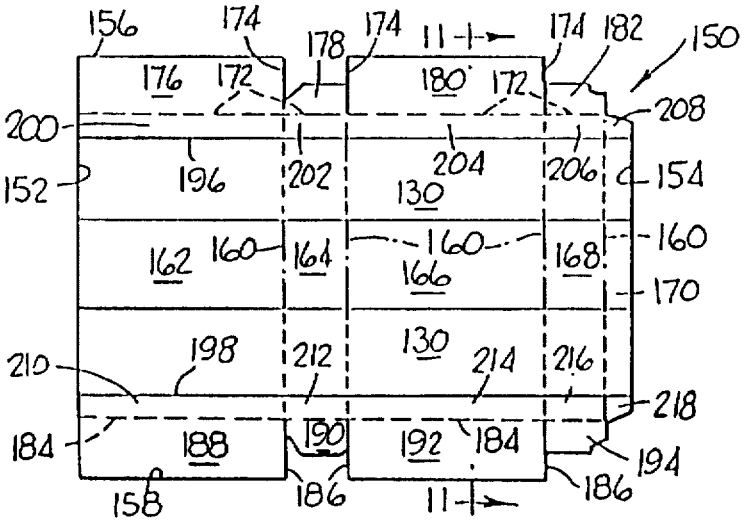
FIG. 10 is a top plan view of a carton blank formed from the laminate of FIG. 8 as it moves through the formation of the cut and fold lines for the top and bottom panels.
Figure 11:
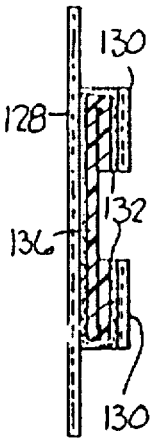
FIG. 11 is a cross-sectional view taken on the line 11—11 of FIG. 10.

In FIG. 7, there is illustrated conventional laminating apparatus 120 used for forming the laminated products of this invention. The laminating apparatus comprises a pair of rotating rolls 122 and 124 having a nip portion 126. A continuous strip 128 of a relatively rigid material, such as a paperboard described in U.S. Pat. No. 4,254,173 dated Mar. 31, 1981 and issued to Peer, Jr., which is incorporated herein by reference thereto, or a conventional clay coated paperboard having surface printing thereon is pulled from a roll (not shown) of such material and fed into the nip portion. At the same time, a plurality of relatively narrow continuous strips 130 of a relatively flexible material, such as a kraft paper, in spaced apart relationship, are pulled from rolls (now shown) of such material and fed into the nip portion 126 to be in spaced apart superposed relationship on the continuous strip 128. A liquid plastic material 132, such as polyethylene or other materials having similar characteristics, or a conventional adhesive material is sprayed into the nip portion 126 by a nozzle 134. A continuous film 136 of a relatively flexible fluid impervious plastic material, such as polypropylene or other materials having similar characteristics, having oppositely facing surfaces 138 and 140 is pulled from a roll (not shown) of such material and fed into the nip portion 126 so that the surface 138 moves into contact with the liquid plastic material 132. As the laminate passes through the nip portion 126, the surface 138 is secured to the coated portions of the continuous strips 130 of a relatively flexible material and the coated portion of the continuous strip 128 of a relatively rigid material. The middle continuous strip 130 has a width twice the width of the end continuous strips 130 so that when forming the carton blanks, described below, the middle continuous strip will be cut in half. After the formation of the laminate described above, the laminate is cut in half along the middle strip 130. Then, the end continuous strips 130 and the portions of the continuous film 136 of a relatively flexible plastic material are folded back upon themselves, as illustrated in FIGS. 10 and 11 and passed through a conventional apparatus for forming cut lines and fold lines to produce a carton blank illustrated in FIG. 10.

The carton blank 150 has a left side edge 152, a right side edge 154, a top edge 156 and a bottom edge 158 with the left side and right side edges 152 and 154 being perpendicular to the top and bottom edges 156 and 158. A plurality of fold lines 160 divide the carton blank 150 into a back panel portion 162, a left side panel portion 164, a front panel portion 166, a right side panel portion 168 and a glue tab panel portion 170. A plurality of fold lines 172 and a plurality of cut lines 174 divide the carton blank 150 into a top back panel portion 176, top left side panel portion 178, top front panel portion 180, and top right side panel portion 182. A plurality of fold lines 184 and cut lines 186 divide the carton blank 150 into bottom back panel portion 188, bottom left side panel portion 190, bottom front panel portion 192 and bottom right side panel portion 194. It is understood that the carton blank illustrated in FIGS. 10 and 11 is for illustration purposed only and that this invention can be used with carton blanks of a variety of configurations.

Figure 8:
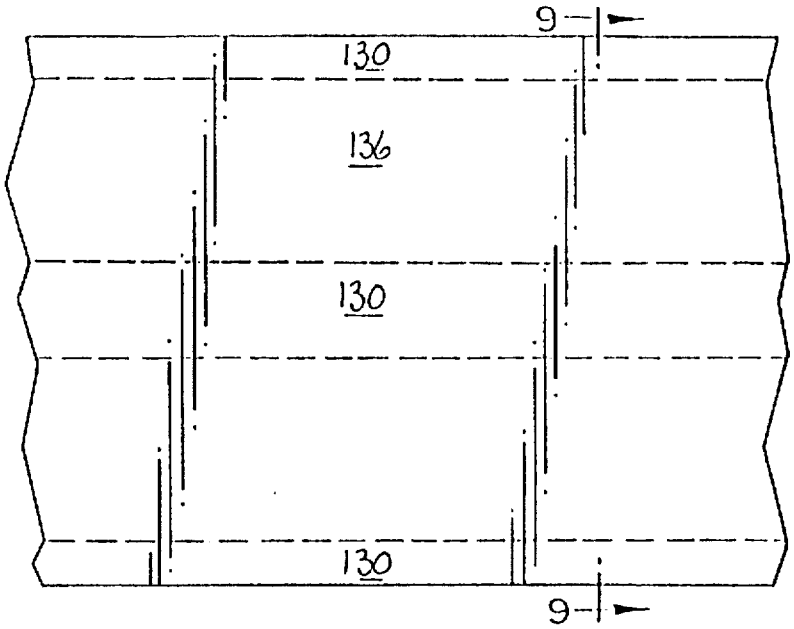
FIG. 8 is a top plan view of a portion of a preferred laminate formed using the apparatus of FIG. 7.
Figure 9:
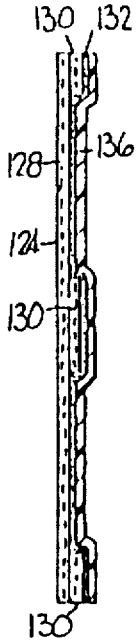
FIG. 9 is a cross-sectional view taken on the line 9—9 of FIG. 8.

The upper continuous strip 130 of FIG. 8 is folded over the fold line 196 and the half of the middle continuous strip 130 has been folded over the fold line 198. After the continuous strips 130 together with the portions of the film 136 secured thereto have been folded over, the laminate is passed through a conventional machine to form the cut and fold lines described above. Prior to forming a carton from the carton blank 150, the upper continuous strips 130 is folded back to overlie the top panel portions 176, 178, 180 and 182 and the portions 200, 202, 204 and 206 of the sidewall panel portions 162, 164, 166 and 168 and the portion 208 of the glue panel portion 170 and the lower continuous strip 130 is folded back to overlie the bottom panel portions 188, 190, 192 and 194 and the portions 210, 212, 214 and 216 of the sidewall panel portions 162, 164, 166 and 168 and the portion 218 of the glue panel portion 170. A carton is then formed and filled as described above in relation to FIGS. 3 and 4. The inner surface of the carton will be the film 136 of the relatively flexible plastic material to form a leakproof carton.

Figure 12:
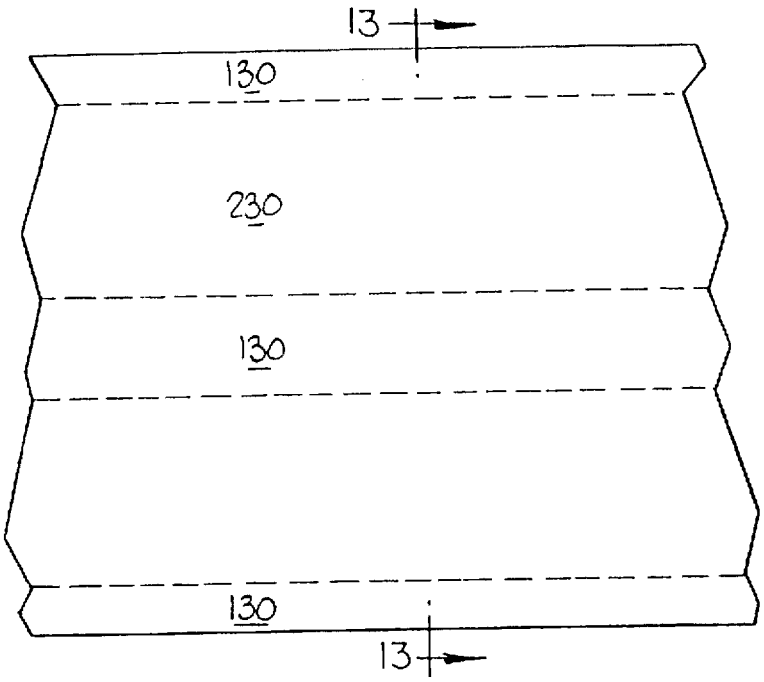
FIG. 12 is a top plan view of a portion of another preferred laminate formed using the apparatus of FIG. 7.
Figure 13:
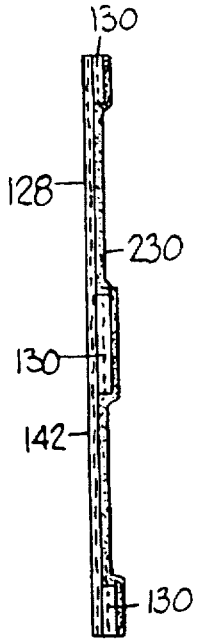
FIG. 13 is a cross-sectional view taken on the line 13—13 of FIG. 12.
Figure 14:
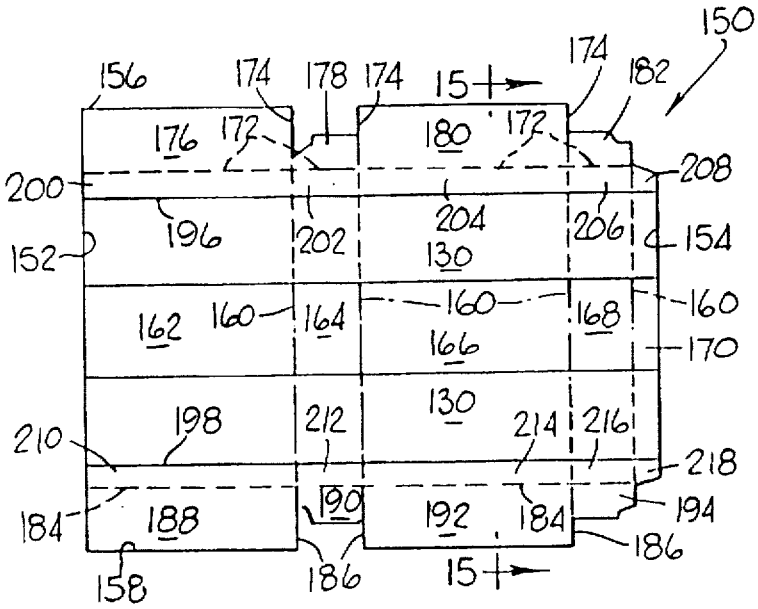
FIG. 14 is a top plan view of a carton blank formed from the laminate of FIG. 12 as it moves through the formation of the cut and fold lines for the top and bottom panels.
Figure 15:
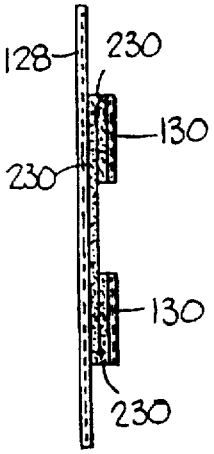
FIG. 15 is a cross-sectional view taken on the line 15—15 of FIG. 14.

The laminate illustrated in FIGS. 12 and 13 is formed using the apparatus of FIG. 7 but does not include the continuous film 136 of a relatively flexible plastic material. A continuous strip 128 of a relatively rigid material, such as paperboard of the type in the Peer, Jr. patent or a conventional clay-coated paperboard, is fed into the nip 126 along with the plurality of continuous strips 130 of a relatively flexible material, such as paper, and a liquid plastic material, such as polyethylene, is fed into the nip 126 and as these materials pass through the nip 126 a continuous coating 230 of the fluid impervious plastic material is formed over the exposed surfaces of the continuous strip 128 and the continuous strips 130. Also, the laminate is cut in half along the middle continuous strip 130 and the continuous strips 130 are folded back as illustrated in FIGS. 14 and 15 so that the cut and fold lines may be made. The continuous strips 130 are folded back, as described above, so that the cartons when formed as in FIGS. 3 and 4 will have a continuous inner surface of a plastic coating 230. In some instances, it may be desirable to use a bead of adhesive to secure an edge portion of each continuous strip 130 to a portion of the continuous strip 128. This can be done when the continuous strips 130 are being superposed over portions of the continuous strip 128 prior to entering the nip 126.

Figure 16:
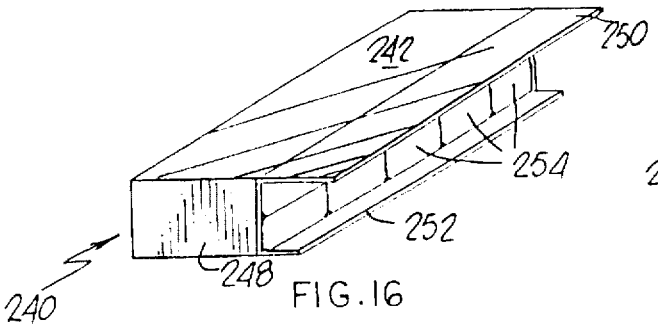
FIG. 16 is a perspective view of another carton of this invention.
Figure 17:
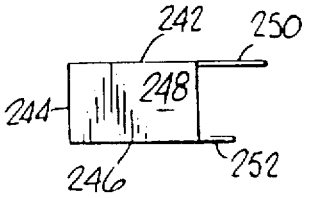
FIG. 17 is an end elevational view of FIG. 16.

In FIGS. 16 and 17, there is illustrated a carton 240 having a plurality of sidewall panels 242, 244 and 246 and sealed together end panels 248. As illustrated in FIGS. 16 and 17, the closure panel 250 and the glue tab panel 252 are in an opened condition so that packages 254 of cigarettes may be inserted therein. At the manufacture's plant for making cigarettes, after the packages 254 have been inserted, the closure panel 250 is temporarily sealed to the glue tab panel 252 and loaded into large boxes for shipment to distributing centers. During shipment the seal between the closure panel and the glue tab panel 252 breaks. This is done because at the distributing centers, it is necessary to apply the state and/or local tax stamps. After the tax stamps have been applied, the closure panel 250 is then permanently sealed to the glue tab panel 252. Since there are so many distributing centers, it is common for them to use conventional apparatus to apply a water base adhesive to secure the closure panel 250 to the glue tab panel 252. When a carton is formed from a composite material such as in the Peer, Jr. patent, glue tab panel 252 has a plastic surface facing the paperboard surface of the closure panel 250. Therefore, since a water based adhesive is not compatible to the plastic surface, a permanent seal cannot be made. Other surface materials may also result in non-compatible surfaces.

Figure 18:
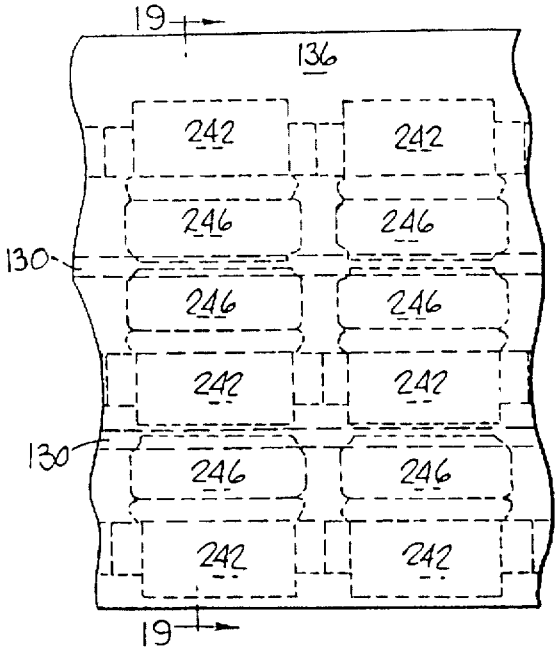
FIG. 18 is a top plan view of a portion of another preferred laminate being formed with the carton blanks to be formed therefrom illustrated in dashed lines.
Figure 19:
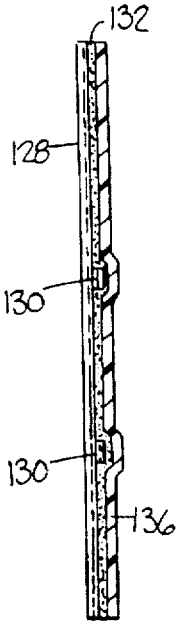
FIG. 19 is a cross-sectional view taken on the line 19—19 of FIG. 18.
Figure 20:
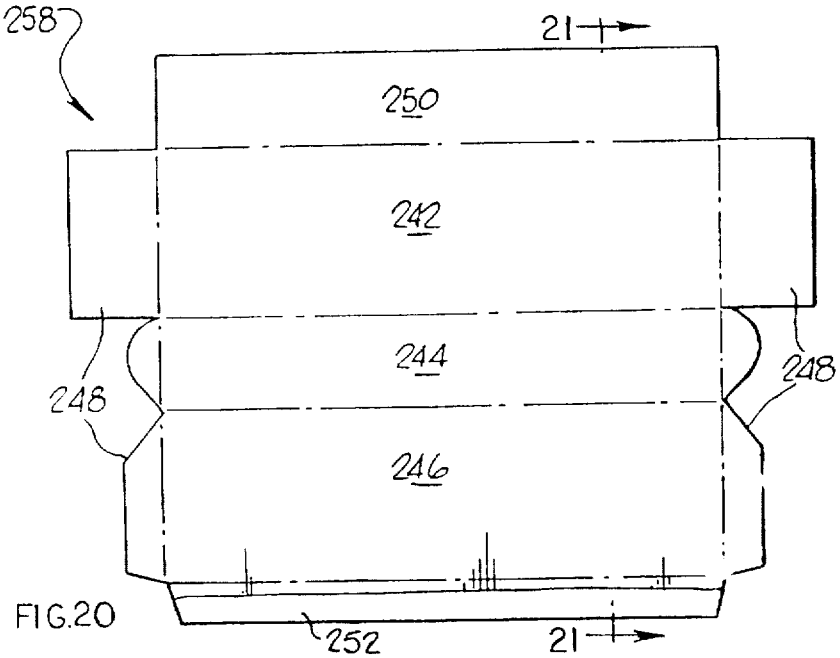
FIG. 20 is a top plan view of one of the carton blanks illustrated in FIG. 18.
Figure 21:
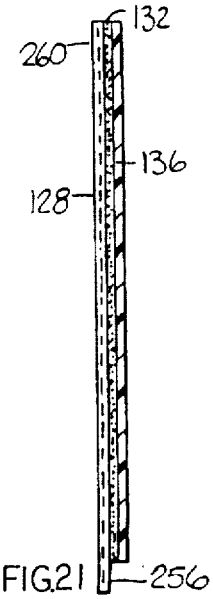
FIG. 21 is a cross-sectional view taken on the line 21—21 of FIG. 20.

In FIGS. 18 and 19, there is illustrated a laminate from which a carton blank can be formed to have a desired reverse printed plastic film as an outer surface and still have compatible paperboard to paperboard surfaces on the closure panel 250 and the glue tab panel 252. The laminate of FIGS. 18 and 19 is formed using the apparatus in FIG. 7. A continuous strip 128 of a relatively rigid material, such as paperboard is fed into the nip 126, and two continuous strips 130 of a relatively flexible material, such as paper, are superposed over portions of the continuous strip 128 so that the liquid plastic material 132 contacts only the exposed surfaces of the continuous strip 128 and the continuous strips 130. A reverse printed plastic film, such as that illustrated in FIG. 7 as 136, is fed into the nip 126 from the other side so that it can be coated by the liquid plastic material 132. After this, the laminate is passed through apparatus, such as a vacuum roll, where the continuous strips 130 with the portion of the plastic film 136 adhered thereto are pulled away from the laminate to leave a portion 256 of the continuous strip 128 exposed. The lower continuous strip 130 has a width that is one-half the width of the upper continuous strip 130. When the carton blank 258 of FIGS. 20 and 21 is folded around the fold lines, the exposed paperboard portion 256 will face the paperboard portion of the closure panel 250 so that a water based adhesive may be used to form a permanent seal between these compatible surfaces. The carton blanks 258 are illustrated in FIG. 18 only to show that the glue tab panel portion 252 extend in the machine direction.

The thickness of the various materials such as the continuous strip 128, the plastic adhesive or coating 132 or 230, the continuous strip 130 and the plastic film have been exaggerated for illustration purposes. The continuous strip 128, the plastic adhesive or coating 132 or 230 and the plastic film would be similar to the corresponding materials in the Peer, Jr. patent. The continuous strips 130 may comprise a kraft paper having a thickness of between about 0.75 and 1.0 mils of other types of materials having similar characteristics.

Figure 22:
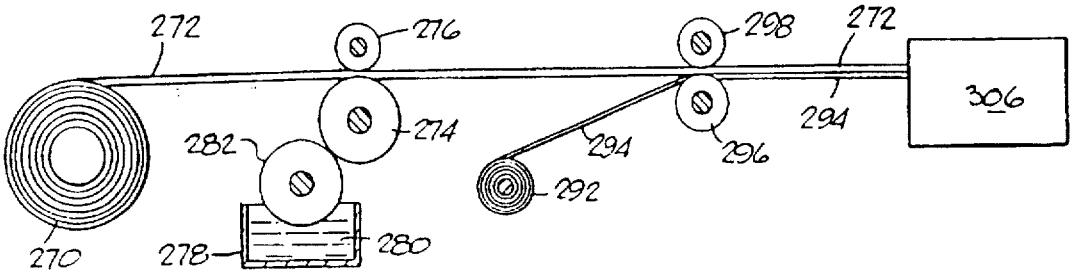
FIG. 22 is a schematic illustration of apparatus forming another preferred embodiment of the invention.
Figure 23:
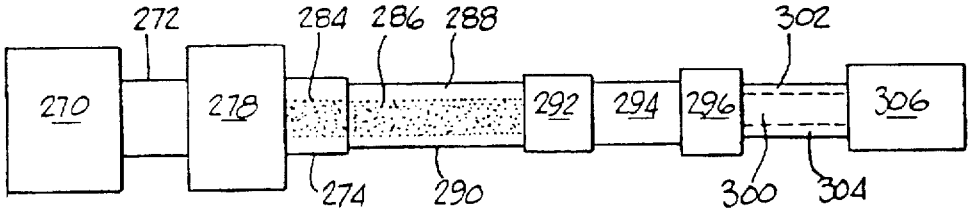
FIG. 23 is a bottom plan view of FIG. 22.

Another preferred embodiment of the invention is schematically illustrated in FIGS. 22 and 23. A roll 270 of a relatively rigid material, such as that described above, is mounted so that a continuous strip 272 may be removed therefrom. The continuous strip 272 is fed between a driven gravure roll 274 and an idler pressure applying roll 276. A supply tank 278 is mounted at a fixed location and holds a supply of a suitable adhesive material 280. A transfer roll 282 is rotatably mounted to pass through the adhesive material 280 and then to contact the raised surface 284 of the gravure roll 274 to coat the raised surface 284 with the adhesive material 280 and the gravure roll 274 then coats the central body portion 286 of the continuous strip 272 with the adhesive material 280 leaving opposite edge portions 288 and 290 uncoated. Although a gravure roll is preferred, it is understood that other types of rolls or other types of conventional laminating apparatus can be used to apply the adhesive material to the continuous strip 272.

A roll 292 of a relatively flexible fluid impervious material is mounted so that a continuous film 294 may be removed therefrom. The roll 292 of a relatively flexible fluid impervious material can comprise a plastic coated paper material, such as that described above, but preferably comprises a laminated material, such as a kraft paper and a film of polypropylene or other materials having similar characteristics laminated thereto or a film of a fluid impervious plastic material. The continuous strip 272 and the continuous film 294 are moved into conventional laminating apparatus having a first roll 296 and a second roll 298 to secure the central body portion 300 of the continuous film 294 to the central body portion 286 of the continuous strip 272 leaving opposite edge portions 302 and 304 unsecured. Either one or both of the first 296 and second 298 rolls may be driven by conventional means (not shown). Also, either one or both of the first 296 and second 298 rolls can have an elastic surface. The continuous strip 272 and the continuous film 294 are then passed through conventional apparatus 306 to provide the continuous strip 272 with cut and fold lines. In FIGS. 22 and 23, the continuous strip 272 is illustrated as being of a width so that only one coating of adhesive is applied thereto. However, it is understood that the continuous strip 272 can have a width so that a plurality of spaced apart adhesive coatings may be applied to the continuous strip 272 so that a continuous film 294 having the same width can also be secured thereto.

Figure 24:
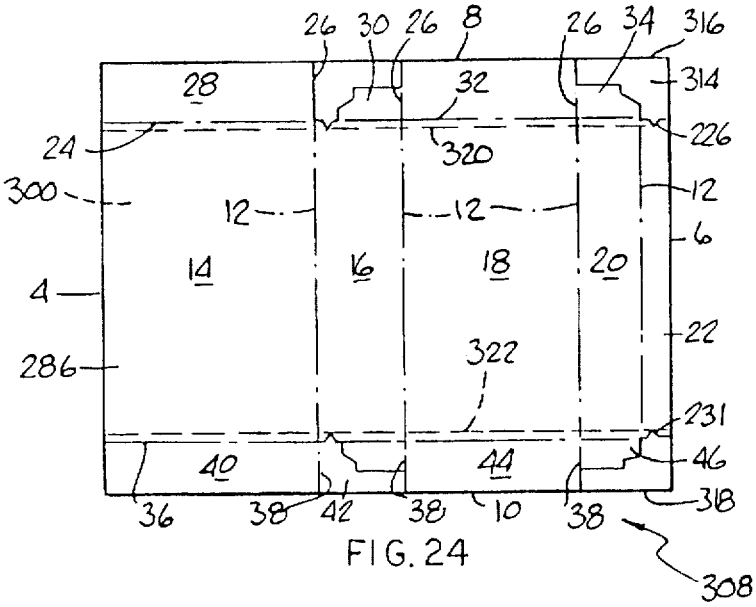
FIG. 24 is a top plan view of a carton blank of another preferred embodiment of the invention.
Figure 25:
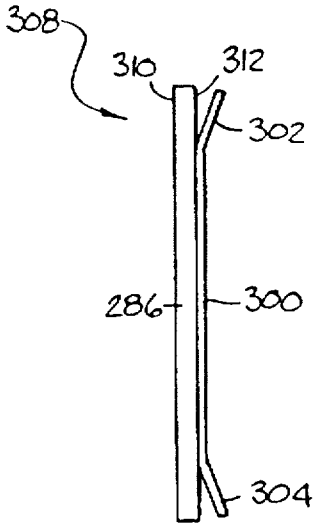
FIG. 25 is an end elevational view taken from the right side of FIG. 24.

In FIGS. 24 and 25, there is illustrated a carton blank 308 formed by the process illustrated in FIGS. 22 and 23. The carton blank 308 has an outer surface 310 and an inner surface 312. The carton blank 308 is similar to the carton blank 2 of FIGS. 1 and 5 and corresponding parts have been identified with the corresponding reference numerals. The central body portion 300 of a rectangularly shaped sheet 314 of the flexible plastic film 294 is adhesively secured to the central body portion 286 of the relatively rigid paperboard material so that the opposite edge portions 302 and 304 are unsecured. As illustrated, portions of the edges of the rectangularly shaped sheet 314 underlie the edges 4, 6, 8 and 10.

As illustrated in FIG. 24, the central body portions 286 and 300 are secured together between the lines 320 and 322. A cut-out 226 is formed in the upper portion of the glue tab panel portion 22 and extends downwardly to the line 320. Also, a cut-out 231 is formed in the lower portion of the glue tab panel portion 22 and extends upwardly to the line 322. Although the cut-outs 226 and 231 are illustrated as v-shaped, it is understood that they can be of other geometrical configurations. Also, although the cut-outs 226 and 231 are illustrated as extending completely through the glue tab panel portion 22, it is understood that they can extend only partially through the glue tab panel portion 22. When a carton is formed from the carton blank 308 by folding around the fold line 12, a continuous bead of adhesive (not shown) is superposed over the upper portion of the rectangularly shaped sheet 314, the cut-out 226, the glue tab panel portion 22, the cut-out 231 and the lower portion of the rectangularly shaped sheet 314. A carton is formed from the carton blank 308 by conventionally forming the edge portion 304, folding and securing the bottom panel portions 40, 42, 44 and 46, filling the carton, conventionally folding the edge portion 302 and folding and securing the top panel portions 28, 30, 32 and 34.

Figure 26:
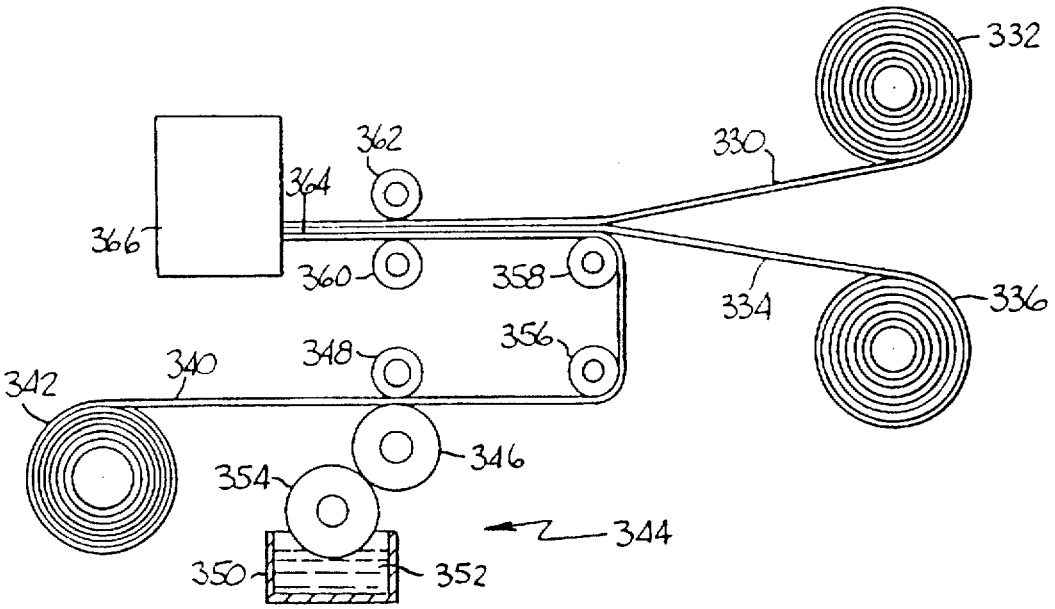
FIG. 26 is a schematic illustration of apparatus forming another preferred embodiment of the invention.

Another preferred embodiment of the invention is schematically illustrated in FIG. 26. A continuous strip 330 of a relatively rigid material, such as paperboard, is pulled from the roll 332. A plurality of spaced apart, relatively narrow continuous strips 334 of a relatively flexible material, similar to the strips 130, are pulled from the rolls 336 and are positioned at spaced apart locations beneath the continuous strip 330 for movement therewith.

A continuous film 340 of a relatively flexible fluid impervious material, such as those described above, is pulled from the roll 342 and fed into an adhesive coating station 344. The continuous film 340 moves between a driven gravure roll 346 having at least one raised surface and an idler pressure applying roll 348. A supply tank 350 is mounted at a fixed location and holds a supply of a suitable adhesive material 352. A transfer roll 354 is rotatably mounted to pass through the adhesive material 352 and then to contact the raised surfaces of the gravure roll 346 to coat them with the adhesive material 352. The coated continuous film 340 passes over guide rollers 356 and 358. The coated continuous film 340, the strips 334 and the continuous strip 330 pass into conventional laminating apparatus having a first roll 360 and a second roll 362, similar to the first 296 and second 298 rolls, to secure the strips 334 to the coated continuous film 340 and the portions of the continuous strip 330 of a relatively rigid material between the strips 334 to the continuous film 340. The laminated product 364 is then fed into conventional apparatus 366 for further processing. Although a gravure roll is preferred, it is understood that other types of rolls can be used to apply the adhesive material to the continuous film 340.

Figure 27:
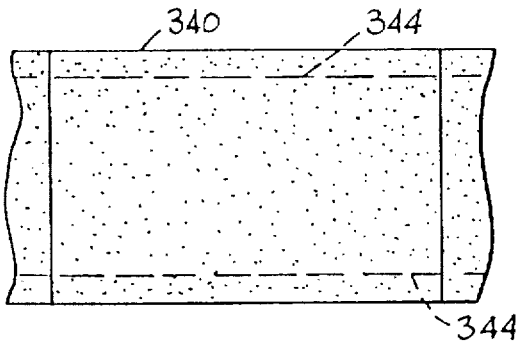
FIGS. 27–29 illustrate various types of adhesive patterns.
Figure 28:
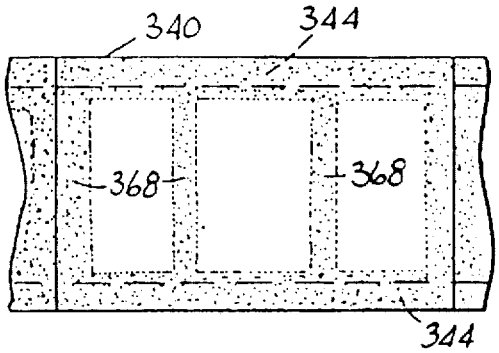
Figure 29:
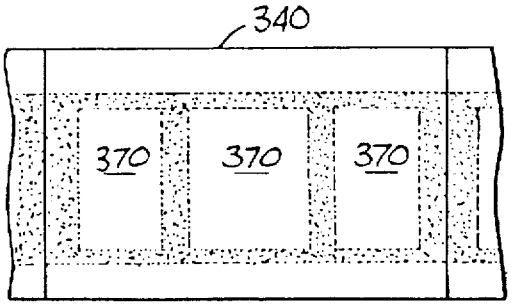

If the gravure roll 346 applies a continuous film of the adhesive material 352 as illustrated in FIG. 27, then the plurality of strips 334 and the portions of the continuous strip 330 between the plurality of strips 334 will be adhered to the continuous film 340. If desired, the gravure roll 346 can apply an adhesive pattern as illustrated in FIG. 28 so that the continuous strip 330 is adhered to the continuous film 340 at spaced apart intervals 368. The gravure roll 346 can apply a pattern of adhesive to the continuous film 340 similar to the pattern illustrated in FIG. 23 to secure the central body portion of the continuous film 340 to the central body portion of the continuous strip 330 or, as a modification illustrated in FIG. 29, the pattern will contain non-adhesive areas 370.

Figure 30:
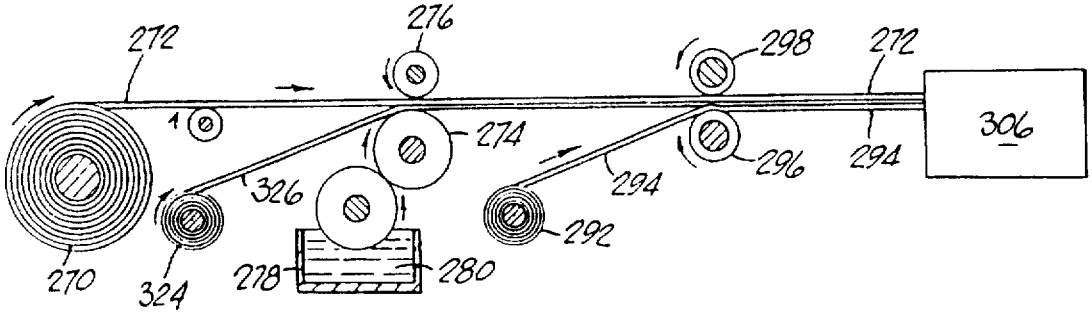
FIG. 30 is similar to FIG. 22 but includes the feeding of a plurality of spaced apart, relatively narrow continuous strips of a relatively flexible material.

The apparatus illustrated in FIG. 30 is similar to the apparatus illustrated in FIG. 22 except that a plurality of spaced apart rolls 324 of a relatively flexible material, such as kraft paper, are located so that spaced apart, relatively narrow continuous strips 326 may be fed into the nip between the gravure roll 274 and the idler roll 276. The gravure roll 274 has a surface pattern to apply an adhesive coating material similar to that illustrated in FIGS. 27 or 28.

Figure 31:
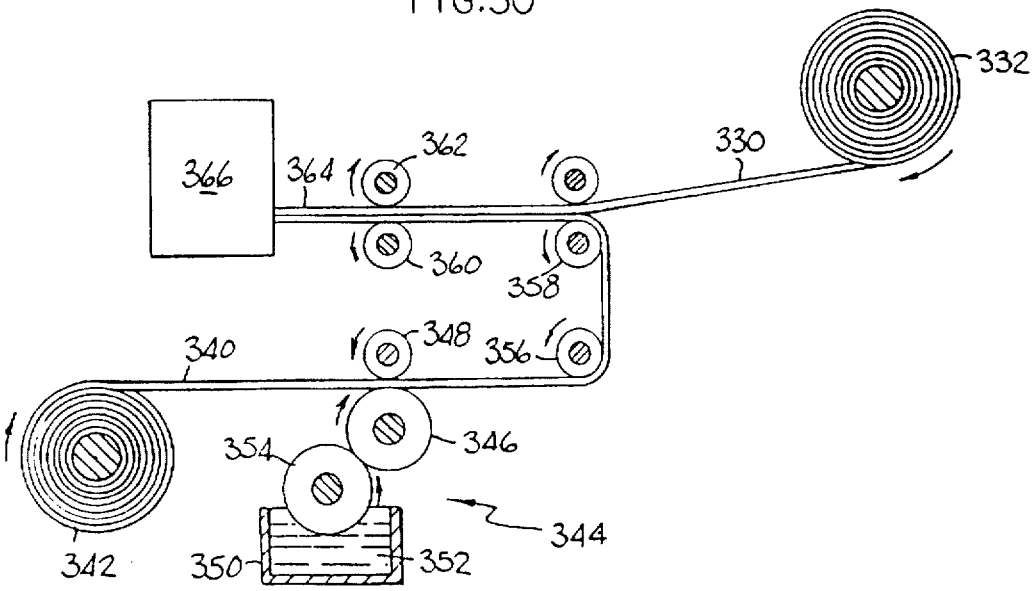
FIG. 31 is similar to FIG. 26 but does not include the feeding of a plurality of spaced apart continuous strips of a relatively flexible material.

The apparatus illustrated in FIG. 31 is similar to the apparatus illustrated in FIG. 26 except that the spaced apart, relatively narrow continuous strips 334 of a relatively flexible material have been excluded. The gravure roll 346 has a surface pattern to apply an adhesive coating material similar to that illustrated in FIGS. 23 or 29 to produce a product illustrated in FIG. 25.

Figure 32:
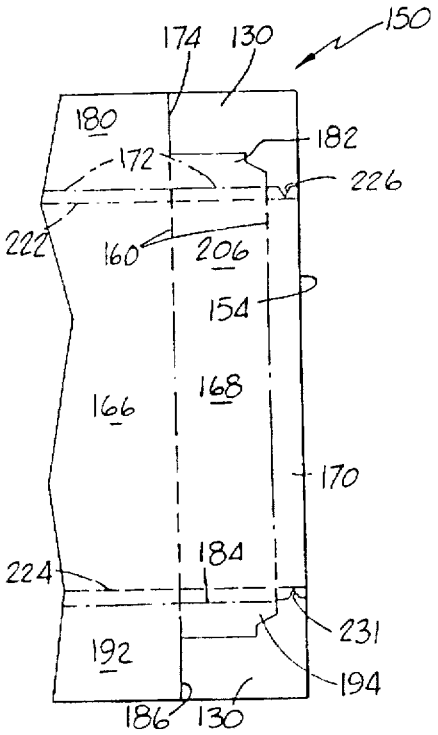
FIG. 32 is a partial top plan view of another preferred embodiment of the invention.
Figure 33:
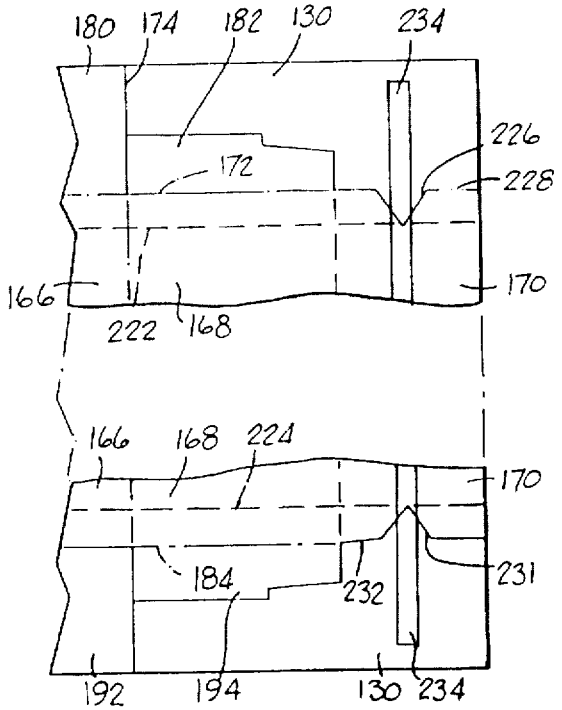
FIG. 33 is an enlarged view of portion of FIG. 32.

In FIGS. 32 and 33, which are similar to FIG. 24, there is illustrated another preferred embodiment of the carton blanks illustrated in FIGS. 10 and 14 and in which corresponding parts are identified with the same reference numerals. When the continuous strips 130 of the relatively flexible material are fed into the apparatus of FIG. 7, there is a maximum tolerance distance that the lower edge 222 of the upper continuous strip 130 can be spaced from the fold line 172 and that the upper edge 224 of the lower continuous strip 130 can be spaced from the fold line 184. A cut-out 226 is formed in the upper portion of the glue tab panel portion 170 and extends downwardly from the upper edge 228 for a distance substantially equal to the maximum tolerance distance. Also, a cut-out 231 is formed in the lower portion of the glue tab panel portion 170 and extends upwardly from the lower edge 232 for a distance substantially equal to the maximum tolerance distance. Although the cut-outs 226 and 230 are illustrated as V-shaped, it is understood that they can be of other geometrical configurations. Also, although the cut-out portions 226 and 231 are illustrated as extending completely through the glue tab panel portion 170, it is understood that they can extend only partially through the glue tab panel portion 170. When a carton is formed from the carton blank of FIGS. 10, 14 and 22 by folding around the fold lines 160, a continuous bead 234 of adhesive, such as a hot melt adhesive, is superposed over the upper continuous strip 130, the cut-out 226, the glue tab panel portion 170, the cut-out 230 and the lower continuous strip 130 so that these portions may be secured to superposed portions of the continuous film 136 of FIG. 10 or the continuous coating 230 of FIG. 14.

Figure 34:
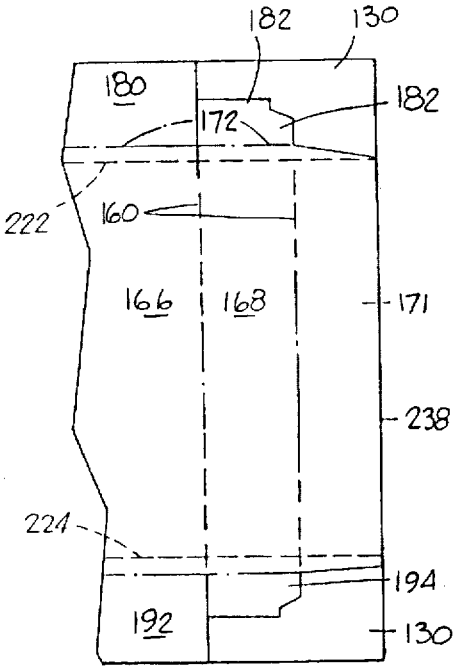
FIG. 34 is a partial top plan view of another preferred embodiment of the invention.
Figure 35:
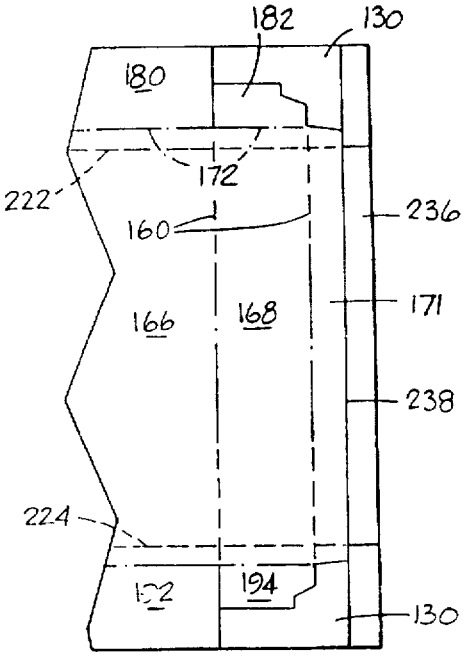
FIG. 35 is a view similar to FIG. 34 after one folding operation.

In FIGS. 34 and 35, there is illustrated another preferred embodiment of the carton blanks illustrated in FIGS. 10 and 14 and in which corresponding parts are identified with the same reference numerals. The glue tab panel portion 171 is wider than the glue tab panel portion 170 and the upper and lower continuous strips 130 and the continuous film are wider. Prior to the folding of the carton blank around the fold lines 160, portions 236 of the upper and lower continuous strips 130 and the glue tab panel portion 171 and the adhesively secured portion of the continuous film 136 are folded back over and secured to adjacent portions of the upper and lower continuous strips 130 and the glue tab panel portion 171. When a carton is formed from the carton blank, a bead (not shown) of adhesive, such as a hot melt adhesive, is superposed over the edge 238 formed by the folded over portions 236.

Figure 36:
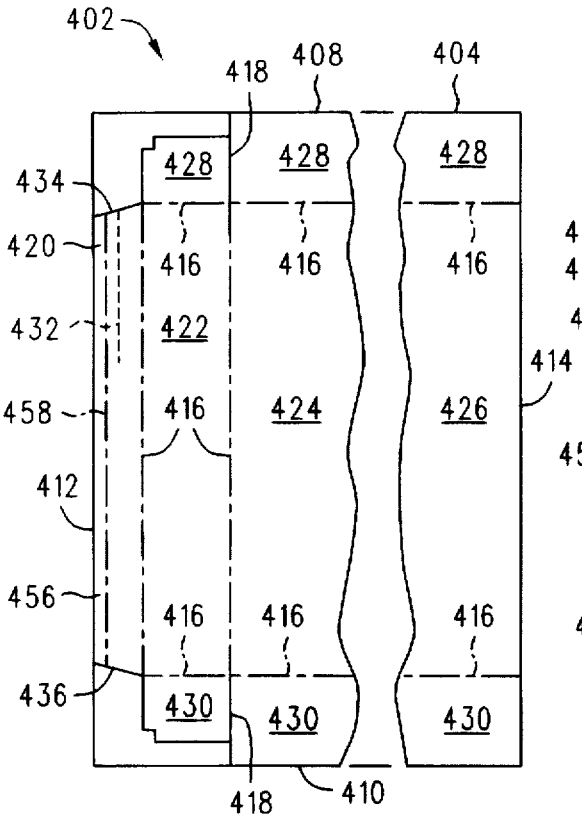
FIG. 36 is a plan view of the outer surface of another embodiment of a carton blank similar to the carton blank illustrated in FIGS. 34 and 35.
Figure 37:
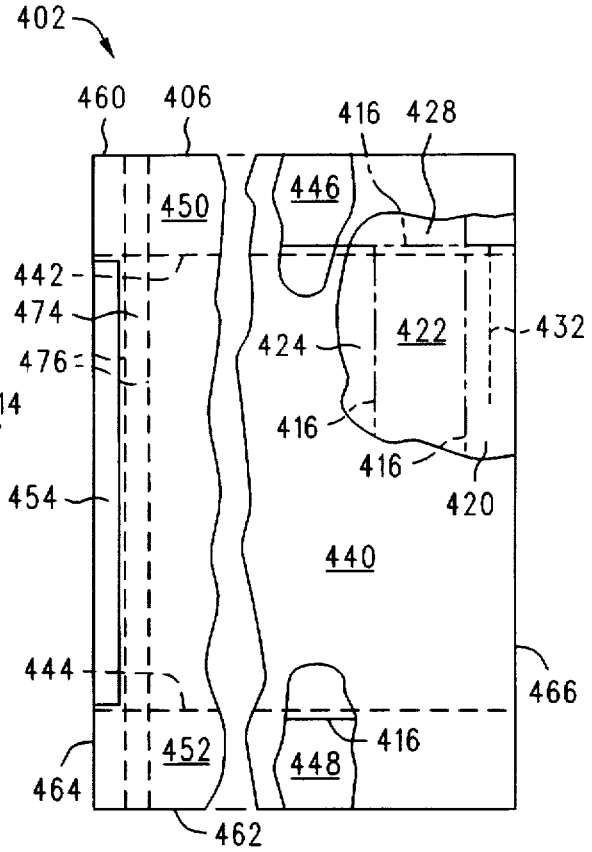
FIG. 37 is a plan view of the inner surface of the carton blank of FIG. 36.
Figure 38:
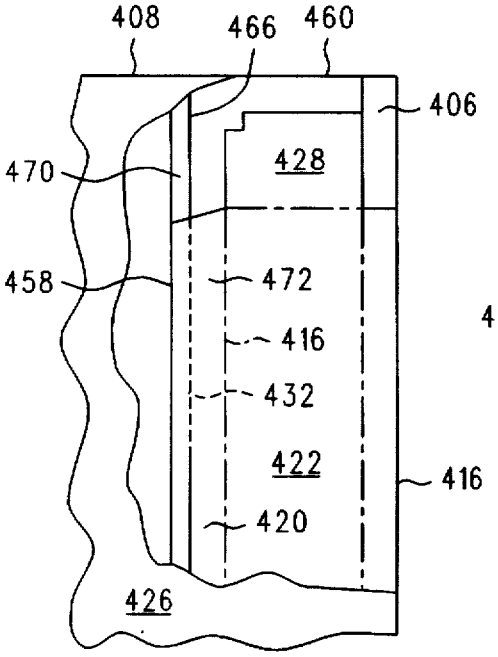
FIG. 38 is a enlarged plan view of a portion of the carton blank of FIGS. 36 and 37 after two folding operations.

Another embodiment of a carton blank is illustrated in FIGS. 36–38. Although the carton blank of FIGS. 36–38 is similar to the carton blanks of FIGS. 10–14, 34 and 35, it will be described using new reference numerals.

As described above, the carton blank 402 has an outer layer comprising a unitary sheet 404 of a relatively rigid material and an inner layer of a generally rectangular sheet 406 of a relatively flexible fluid impervious material.

As illustrated in FIG. 36, the unitary sheet 404 has a top edge 408, a bottom edge 410, a left side edge 412 and a right side edge 414. The unitary sheet 404 has a plurality of fold lines 416 and cut lines 418 to divided the unitary sheet into a glue tab panel 420, apposite sidewall panels 422 (only one of which is shown), a back panel 424, a front panel 426 (it is understood that these reference numerals could be reversed), a plurality of top panels 428 and a plurality of bottom panels 430. A perforated line 432 is formed in the glue tab panel 420 for purposes described below. The perforated line 432 is illustrated as terminating between the top edge 434 and the bottom edge 436 of the glue tab panel 420 but could extend completely to the bottom edge 436 for purposes described below.

As illustrated in FIG. 37, the generally rectangular sheet 406 has a central body portion 440 that is secured to the underlying central body portion of the unitary sheet 404 between the line 442 located slightly below the fold line 416 between the top panels 428, the sidewall panel 422 and the front and back panels 424 and 426 and the line 444 located slightly above the fold line 416 between the bottom panels 430 and the sidewall panel 422 and the front and back panels 424 and 426. The generally rectangular sheet 406 has a top body portion 450 and a bottom body portion 452. The unitary sheet 404 has corresponding underlying top and bottom body portions. Strips of a relatively flexible material 446 and 448 are secured to the top body portion 450 and the bottom body portion 452 of the generally rectangular sheet 406. During the manufacture of the carton blank 402, a portion 454 of the central body portion 440 is removed for purposes described below. This portion 454 is preferably removed by not adhering it to the unitary sheet 404 and the passing it over heating means. It is understood that other methods can be used to form the portion 454. Also, during the folding and gluing operation, a portion 456 of the glue tab panel 420, located between the perforated line 432 and the left side edge 412 and extending from the top edge 434 and the bottom edge 436, is skived away and a fold line 458 is formed therein for purposes described below. Preferably, the portion 456 is spaced a short distance from the perforated line 432. The generally rectangular sheet 406 has a top edge 460 a bottom edge 462, a left side edge 464 and a right side edge 466.

In FIG. 38, there is illustrated the formation of an open ended enclosure from the carton blank 402. The glue tab panel 420 and the sidewall panel 422 have been folded around the fold line 416 between the sidewall panel 422 and the back panel 424. The portion of the generally rectangular sheet 406 and the top and bottom wall panels 428 and 430 integral with the sidewall panel 422 move therewith. The skived portion 456 is folded around the fold line 458 to form an exposed continuous strip 470 of the relatively flexible fluid impervious material. The front panel 426 is folded around the fold line between it and another sidewall panel (not shown) until the portion 454 overlies the portion 472 of the glue tab panel 420 and a strip 474, illustrated by the dashed lines 476 in FIG. 37, of the relatively flexible fluid impervious material overlies the continuous strip 470. The portions 454 and 472 are secured together, preferably by a relatively good adhesive bond, to hold the unitary sheet 404 of a relatively rigid material in a desired relationship. The strips 474 and 470 are secured together, preferably by a relatively good adhesive bond, to form a continuous inner enclosure with open ends of the generally rectangular sheet 406 of a relatively flexible fluid impervious material secured to the unitary sheet of a relatively rigid material.

When it is desired to form and fill a carton 480, the opposite sidewall panels 422 and the front and back wall panels 426 and 424 are formed into an open ended hollow rectangular shape. The adjacent portions of the bottom body portion 452 are folded and sealed together and the bottom panels 430 are folded and sealed together. The partially formed carton is then filled with a desired material. The adjacent portions of the top body portion 450 are folded and sealed together, such as illustrated in FIGS. 3 and 4, and folded down and the top panels 428 are folded and sealed together to form a filled carton.

When it is desired to remove material from the carton 480, the top panels 428, which have been secured together by a relatively weak adhesive bond are opened and then the adjacent portions of the top body portion 450, which also have been secured together by a relatively weak adhesive bond, are separated and the desired amount of material is removed. The adjacent portions of the top body portion 450 are then folded down into the carton and the top panels 428 are folded and held together by a conventional joint.

Figure 39:
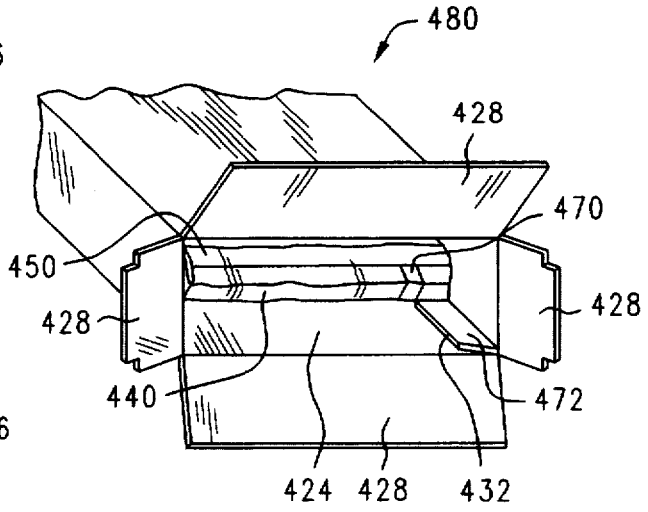
FIG. 39 is a perspective view of a carton formed from the carton blank of FIGS. 36 and 37 after some of the material contained therein has been removed.

In FIG. 39, there is illustrated the operation of the folding of the top body portion 450 into the carton 480. The central body portion 440 of the generally rectangular sheet 406 is secured to the central body portion of the unitary sheet 404 so that as the top and central body portions 450 and 440 are folded down into the carton 480, the continuous strip 470 and the folded together skived portion 456 will separate along the perforated line 432 and move with the central body portion 440. If desired, the perforated line 432 can extend from the top edge 434 to the body edge 436, so that, when all the material is removed from the carton 480, the generally rectangular sheet 406 may be completely separated from the unitary sheet 404 for separate disposal.

It is contemplated that the inventive concepts herein described may be variously otherwise embodied and it is intended that the appended claims be construed to include alternative embodiments of the invention except insofar as limited by the prior art.

What is claimed is:

1. A carton blank comprising:

a unitary sheet of a relatively rigid material having an inner surface and an outer surface;

said unitary sheet of a relatively rigid material having a left side edge, a right side edge, a top edge and a bottom edge;

said unitary sheet of a relatively rigid material having a length extending from said top edge to said bottom edge and a width extending from said left side edge to said right side edge;

said unitary sheet of a relatively rigid material having a plurality of cut and fold lines for dividing said unitary sheet of a relatively rigid material into a back wall panel, a front wall panel, opposite side wall panels, a glue tab panel and top and bottom panels extending outwardly in opposite directions from said front wall, back wall and opposite sidewall panels;

said glue tab panel having a top edge and a bottom edge and a perforated line extending from said top edge toward said bottom edge;

said inner surface of said front wall panel, said back wall panel, said opposite sidewall panels and said glue tab panel having a central body portion, a top body portion and a bottom body portion;

said central body portion located between and spaced from said fold lines between said front wall panel, said back wall panel and said opposite sidewall panels and said top and bottom panels and extending into said glue tab panel;

a generally rectangular sheet of a relatively flexible fluid impervious material having an inner surface and an outer surface with said outer surface having a central body portion, a top body portion a bottom body portion, a left side edge, a right side edge and top and bottom edges;

said generally rectangular sheet of a relatively flexible fluid impervious material having a length and a width corresponding to said length of said width of said unitary sheet of a relatively rigid material;

said central body portion of said rectangular sheet of a relatively flexible fluid impervious material being secured to said central body portion of said front wall panel, said back wall panel said opposite sidewall panels and said glue tab panel;

at least portions of said central body portion of said generally rectangular sheet of a relatively flexible fluid impervious material being secured by an adhesive permitting separation thereof from adjacent portions of said central body portion of said front panel, said back panel, said opposite sidewall panels and portions of said glue tab panel without damage thereto by the application of sufficient force; and at least portions of said top and bottom body portion of said generally rectangular sheet of a relatively flexible fluid impervious material overlying but not secured to said top and bottom body portion of said front wall panel, said back wall panel, said opposite sidewall panels and said glue tab panel and said inner surface of said top and bottom panels.

2. A carton blank as in claim 1 and further comprising:

a sheet of a relatively flexible material secured to said top and bottom body portions of said generally rectangular sheet of a relative flexible fluid impervious material.

3. A carton blank as in claim 2 and further comprising:

at least portions of said glue tab panel between said perforated line and one of said left or right side edges being secured to other portions of said central body portion of said generally rectangular sheet of a relatively flexible fluid impervious material with a relatively permanent adhesive so that said at least portions of said glue tab panel move with said other portions of said central body portion of said rectangular sheet of a relatively flexible fluid impervious material as said at least portions of said generally rectangular sheet are being separated from said central body portion of said front panel, said back panel, said opposite sidewall panels and the adjacent portions of said glue tab panel.

4. A carton blank as in claim 3 and further comprising:

a fold line formed in said glue tab extending from said top edge thereof to said bottom edge thereof and having at least a portion thereof located between said perforated line and said one of said left or right side edges; and said central body portion of said rectangular sheet of a relatively flexible fluid impervious material having an edge portion that is spaced from and parallel to the other of said left or right edges so that when said glue tab panel is folded around said fold line, outer surface of said glue tab panel comprises a portion of said outer surface of said unitary sheet of a relatively rigid material and a portion of said generally rectangular sheet of a relatively flexible fluid impervious material.

5. A carton blank as in claim 4 and further comprising:

the portion of said unitary sheet of a relatively rigid material forming the facing surfaces of said folded over portion of said glue tab panel having a thickness of approximately one-half of the thickness of the other portions of said unitary sheet of a relatively rigid material.

6. A carton blank as in claim 1 and further comprising:

at least portion of said glue tab panel between said perforated line and one of said left or right side edges being secured to said central body portion of said generally rectangular sheet of a relatively flexible fluid impervious material with an adhesive so that said portion moves with said at least portion of said central body portion of said rectangular sheet of a relatively flexible fluid impervious material as said at least portions are being separated from said central body portion of said front wall panel, said back wall panel, said opposite sidewall panels and the adjacent portion of said glue tab panel.

7. A carton blank as in claim 6 and further comprising:

a fold line formed in said glue tab extending from said top edge thereof to said bottom edge thereof and having at least a portion thereof located between said perforated line and said one of said left or right side edges; and said central body portion of said rectangular sheet of a relatively flexible fluid impervious material having an edge portion that is spaced from and parallel to the other of said left or right edges so that when said glue tab panel is folded around said fold line, outer surface of said glue tab panel comprises a portion of said outer surface of said unitary sheet of a relatively rigid material and a portion of said generally rectangular sheet of a relatively flexible fluid impervious material.

8. A carton blank as in claim 7 and further comprising:

the portion of said unitary sheet of a relatively rigid material forming the facing surfaces of said folded over portion of said glue tab panel having a thickness of approximately one-half of the thickness of the other portions of said unitary sheet of a relatively rigid material.

9. A carton blank comprising:

a unitary sheet of a relatively rigid material having an inner surface and an outer surface;

said unitary sheet of a relatively rigid material having a left side edge, a right side edge, a top edge and a bottom edge;

said unitary sheet of a relatively rigid material having a length extending from said top edge to said bottom edge and a width extending from said left side edge to said right side edge;

said unitary sheet of a relatively rigid material having a plurality of cut and fold lines for dividing said unitary sheet of a relatively rigid material into a back wall panel, a front wall panel, opposite side wall panels, a glue tab panel and top and bottom panels extending outwardly in opposite directions from said front wall, back wall and opposite sidewall panels;

said glue tab panel having a top edge and a bottom edge and a perforated line extending from said top edge toward said bottom edge;

said inner surface of said front wall panel, said back wall panel, said opposite sidewall panels and said glue tab panel having a central body portion, a top body portion and a bottom body portion;

said central body portion located between and spaced from said fold lines between said front wall panel, said back wall panel and said opposite sidewall panels and said top and bottom panels and extending into said glue tab panel;

a generally rectangular sheet of a relatively flexible fluid impervious material having an inner surface and an outer surface with said outer surface having a central body portion, a top body portion a bottom body portion, a left side edge, a right side edge and top and bottom edges;

said generally rectangular sheet of a relatively flexible fluid impervious material having a length and a width corresponding to said length of said width of said unitary sheet of a relatively rigid material;

said central body portion of said rectangular sheet of a relatively flexible fluid impervious material being secured to said central body portion of said front wall panel, said back wall panel said opposite sidewall panels and said glue tab panel;

said central body portion of said generally rectangular sheet of a relatively flexible fluid impervious material being secured by an adhesive permitting separation thereof from adjacent portions of said central body portion of said front wall panel, said back wall panel, said opposite sidewall panels and said glue tab panel without damage thereto by the application of sufficient force; and at least portions of said top and bottom body portion of said generally rectangular sheet of a relatively flexible fluid impervious material overlying but not secured to said top and bottom body portion of said front wall panel, said back wall panel, said opposite sidewall panels and said glue tab panel and said inner surface of said top and bottom panels.

10. A carton blank as in claim 9 and further comprising:

at least portion of said glue tab panel between said perforated line and one of said left or right side edges being secured to said central body portion of said generally rectangular sheet of a relatively flexible fluid impervious material with an adhesive so that said portion moves with said at least portion of said central body portion of said rectangular sheet of a relatively flexible fluid impervious material as said at least portions are being separated from said central body portion of said front wall panel, said back wall panel, said opposite sidewall panels and the adjacent portion of said glue tab panel.

11. A carton blank as in claim 10 and further comprising:

a fold line formed in said glue tab extending from said top edge thereof to said bottom edge thereof and having at least a portion thereof located between said perforated line and said one of said left or right side edges; and said central body portion of said rectangular sheet of a relatively flexible fluid impervious material having an edge portion that is spaced from and parallel to the other of said left or right edges so that when said glue tab panel is folded around said fold line, outer surface of said glue tab panel comprises a portion of said outer surface of said unitary sheet of a relatively rigid material and a portion of said generally rectangular sheet of a relatively flexible fluid impervious material.

12. A carton blank as in claim 11 and further comprising:

the portion of said unitary sheet of a relatively rigid material forming the facing surfaces of said folded over portion of said glue tab panel having a thickness of approximately one-half of the thickness of the other portions of said unitary sheet of a relatively rigid material.

13. A carton formed from a carton blank comprising a unitary sheet of a relatively rigid material having an inner surface and an outer surface; said unitary sheet of a relatively rigid material having a left side edge, a right side edge, a top edge and a bottom edge; said unitary sheet of a relatively rigid material having a length extending from said top edge to said bottom edge and a width extending from said left side edge to said right side edge; said unitary sheet of a relatively rigid material having a plurality of cut and fold lines for dividing said unitary sheet of a relatively rigid material into a back wall panel, a front wall panel, opposite side wall panels, a glue tab panel and top and bottom panels extending outwardly in opposite directions from said front wall, back wall and opposite sidewall panels; said glue tab panel having a top edge and a bottom edge and a perforated line extending from said top edge toward said bottom edge; said inner surface of said front wall panel, said back wall panel, said opposite sidewall panels and said glue tab panel having a central body portion, a top body portion and a bottom body portion; said central body portion located between and spaced from said fold lines between said front wall panel, said back wall panel and said opposite sidewall panels and said top and bottom panels and extending into said glue tab panel; a generally rectangular sheet of a relatively flexible fluid impervious material having an inner surface and an outer surface with said outer surface having a central body portion, a top body portion a bottom body portion, a left side edge, a right side edge and top and bottom edges; said generally rectangular sheet of a relatively flexible fluid impervious material having a length and a width corresponding to said length of said width of said unitary sheet of a relatively rigid material; said central body portion of said rectangular sheet of a relatively flexible fluid impervious material being secured to said central body portion of said front wall panel, said back wall panel said opposite sidewall panels and said glue tab panel; at least portion of said central body portion of said generally rectangular sheet of a relatively flexible fluid impervious material being secured by an adhesive permitting separation thereof from adjacent portions of said central body portion of said front wall panel, said back wall panel, said opposite sidewall panels and said glue tab panel without damage thereto by the application of sufficient force; and at least portions of said top and bottom body portion of said generally rectangular sheet of a relatively flexible fluid impervious material overlying but not secured to said top and bottom body portion of said front wall panel, said back wall panel, said opposite sidewall panels and said glue tab panel and said inner surface of said top and bottom panels, a sheet of a relatively flexible material secured to said top and bottom body portions of said generally rectangular sheet of a relative flexible fluid impervious material, at least portion of said glue tab panel between said perforated line and one of said left or right side edges being secured to said central body portion of said generally rectangular sheet of a relatively flexible fluid impervious material with an adhesive so that said portion moves with said at least portion of said central body portion of said rectangular sheet of a relatively flexible fluid impervious material as said at least portions are being separated from said central body portion of said front wall panel, said back wall panel, said opposite sidewall panels and the adjacent portion of said glue tab panel, a fold line formed in said glue tab extending from said top edge thereof to said bottom edge thereof and having at least a portion thereof located between said perforated line and said one of said left or right side edges, and said central body portion of said rectangular sheet of a relatively flexible fluid impervious material having an edge portion that is spaced from and parallel to the other of said left or right edges so that when said glue tab panel is folded around said fold line, outer surface of said glue tab panel comprises a portion of said outer surface of said unitary sheet of a relatively rigid material and a portion of said generally rectangular sheet of a relatively flexible fluid impervious material said portion of said unitary sheet of a relatively rigid material forming the facing surfaces of said folded over portion of said glue tab panel having a thickness of approximately one-half of the thickness of the other portions of said unitary sheet of a relatively rigid material comprising:

said unitary sheet of a relatively rigid material and said generally rectangular sheet of a relatively flexible fluid impervious material have been folded and sealed to form an open ended enclosure wherein a portion of said outer surface of said glue tab panel is secured to a portion of said inner surface of one of said front or back panels and portions of said generally rectangular sheet of a relatively flexible fluid impervious material adjacent to said right and left side edges thereof are continuously sealed together from said top edge to said bottom edge thereof;

said bottom body portion of said generally rectangular sheet of a relatively flexible fluid impervious material being folded and secured together and said bottom panel portions being folded and secured together to form a bottom closed end so that the carton can be filled with a desired material; and said top body portion of said generally rectangular sheet of a relatively flexible fluid impervious material being folded and secured together and said top panel portions being folded and secured together to form a closed top end.

14. A method for forming an open ended enclosure from a carton blank comprising a unitary sheet of a relatively rigid material having an inner surface and an outer surface; said unitary sheet of a relatively rigid material having a left side edge, a right side edge, a top edge and a bottom edge; said unitary sheet of a relatively rigid material having a length extending from said top edge to said bottom edge and a width extending from said left side edge to said right side edge; said unitary sheet of a relatively rigid material having a plurality of cut and fold lines for dividing said unitary sheet of a relatively rigid material into a back panel, a front panel, opposite side wall panels, a glue tab panel and top and bottom panels extending outwardly in opposite directions from said front, back and opposite sidewall panels; said glue tab panel having a top edge and a bottom edge and a perforated line extending from said top edge and at least toward said bottom edge; said inner surface of said front panel, said back panel, said opposite sidewall panels and said glue tab panel having a central body portion, a top body portion and a bottom body portion; said central body portion located between and spaced from said fold lines between said front panel, said back panel and said opposite sidewall panels and extending into said glue tab panel; a generally rectangular sheet of a relatively flexible fluid impervious material having an inner surface and an outer surface with said outer surface having a central body portion, a top body portion a bottom body portion, a left side edge, a right side edge and top and bottom edges; said generally rectangular sheet of a relatively flexible fluid impervious material having a length and a width corresponding to said length of said width of said unitary sheet of a relatively rigid material; said central body portion of said rectangular sheet of a relatively flexible fluid impervious material being secured to said central body portion of said front panel, said back panel said opposite sidewall panels and said glue tab panel; at least portions of said central body portion of said generally rectangular sheet of a relatively flexible fluid impervious material being secured by an adhesive permitting separation thereof from adjacent portions of said central body portion of said front panel, said back panel, said opposite sidewall panels and said glue tab panel without damage thereto by the application of sufficient force; said at least portions extending downwardly from said top body portion toward said bottom body portion thereof; and at least portions of said top and bottom body portion of said generally rectangular sheet of a relatively flexible fluid impervious material overlying but not secured to said top and bottom body portions of said front panel, said back panel, said opposite sidewall panels and said glue tab panel and said inner surface of said top and bottom panels; a sheet of a relatively flexible material secured to said top and bottom body portions of said generally rectangular sheet of a relative flexible fluid impervious material; at least portion of said glue tab panel between said perforated line and one of said left or right side edges being secured to other portions of said central body portion of said generally rectangular sheet of a relatively flexible fluid impervious material with a relatively permanent adhesive so that at least said portions of said glue tab panel move with said portions of said central body portion of said rectangular sheet of a relatively flexible fluid impervious material as said at least portions are being separated from said central body portion of said front panel, said back panel, said opposite sidewall panels and said adjacent portions of said glue tab panel; a fold line formed in said glue tab panel extending from said top edge thereof to said bottom edge thereof and having at least a portion thereof located between said perforated line and said one of said left or right side edges; and said central body portion of said rectangular sheet of a relatively flexible fluid impervious material having an edge portion that is spaced from and parallel to the other of said left or right edges so that a portion of the inner surface of said unitary sheet of a relatively rigid material is exposed comprising:

folding said glue tab panel and one of said opposite sidewall panels and the portion of said generally rectangular sheet of a relatively flexible fluid impervious material secured thereto around a fold line between said one of said opposite sidewall panels and one of said front or back wall panels and forming extended fold lines in said top and bottom body portions of said generally rectangular sheet of a relatively flexible fluid impervious material;

folding said at least portions of said glue tab panel located between said perforated line and said one of said left or right side edges and said other portions of the generally sheet of a relatively flexible fluid impervious material secured thereto around said fold line in said glue tab panel and extending the fold line into portions of said top and bottom body portions of said generally rectangular sheet of a relatively flexible fluid impervious material to form a continuous strip of said generally rectangular sheet of a relatively flexible fluid impervious material facing in the same direction as the outer surface of the remaining portion of the outer surface of said glue tab panel;

folding the other of said front or back panels and the portion of the generally rectangular sheet of a relatively flexible fluid impervious material secured thereto around a fold line between said other of said front or back wall panels and the other of said opposite sidewall panels and forming extended fold lines in said top and bottom body portions of said generally rectangular sheet of a relatively flexible fluid impervious material; and sealing together facing portions of said outer surface of said glue tab panel and said exposed inner surface of said other of said front or back panels and facing portions of said continuous strip of a relatively flexible fluid impervious material and portions of said generally rectangular sheet of a relatively flexible fluid impervious material secured to the other of said front or back panels and the extensions thereof into said top and bottom body portions of said generally rectangular sheet of a relatively flexible fluid impervious material to form an open ended enclosure having a continuous inner surface formed from said generally rectangular sheet of a relatively flexible fluid impervious material.

15. A method as in claim 14 and further comprising:

forming a carton from said open ended enclosure comprising;

sealing together portions of said bottom body portion of said generally rectangular sheet of a relatively flexible material and said bottom panels to formed a carton having an open top and a closed bottom;

filling said carton with a desired material; and sealing together portions of said top body portion of said generally rectangular sheet of a relatively flexible fluid impervious material and said top panels to form a closed top.

16. A method as in claim 15 and further comprising:

opening said top panel portion and said portions of said top body portion of said generally rectangular sheet of a relatively flexible fluid impervious material;

removing some of said material from said carton;

folding said top body portion and portions said central body portion of said generally rectangular sheet of a relatively flexible fluid impervious material to reclose said opening; and severing said at least portions of said glue tab panel along said perforated line so that said portion of said glue tab panel may be folded with said central body portion of said generally rectangular sheet of a relatively flexible fluid impervious material.

17. A method as in claim 16 and further comprising:

separating said generally rectangular sheet of a relatively flexible fluid impervious material completely from said unitary sheet of a relatively rigid material.

* * * * *